US011646519B2

(12) United States Patent
Yamaguchi

(10) Patent No.: US 11,646,519 B2
(45) Date of Patent: May 9, 2023

(54) ELECTRIC CONNECTOR FOR FLAT CONDUCTOR

(71) Applicant: HIROSE ELECTRIC CO., LTD., Kanagawa (JP)

(72) Inventor: Shohei Yamaguchi, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/512,186

(22) Filed: Oct. 27, 2021

(65) Prior Publication Data

US 2022/0149551 A1 May 12, 2022

(30) Foreign Application Priority Data

Nov. 6, 2020 (JP) ..... JP2020-186072

(51) Int. Cl.

| | |
|---|---|
| ***H01R 13/15*** | (2006.01) |
| ***H01R 12/72*** | (2011.01) |
| ***H01R 12/85*** | (2011.01) |
| ***H01R 12/70*** | (2011.01) |
| ***H01R 13/629*** | (2006.01) |
| ***H01R 13/639*** | (2006.01) |
| ***H01R 12/77*** | (2011.01) |

(52) U.S. Cl.

CPC ..... *H01R 12/727* (2013.01); *H01R 12/7005* (2013.01); *H01R 12/77* (2013.01); *H01R 12/85* (2013.01); *H01R 13/629* (2013.01); *H01R 13/639* (2013.01)

(58) Field of Classification Search

CPC ..... H01R 12/727; H01R 12/77; H01R 13/774
See application file for complete search history.

(56) References Cited

U.S. PATENT DOCUMENTS 4,367,006 A * 1/1983 Rehbogen, Jr. ..... H01R 12/82 439/495
4,647,131 A * 3/1987 Van Woensel ..... H01R 12/774 439/456
4,992,052 A * 2/1991 Verhoeven ..... H01R 12/721 439/62

(Continued)

FOREIGN PATENT DOCUMENTS

JP 61-194263 U 12/1986

*Primary Examiner* — Neil Abrams
(74) *Attorney, Agent, or Firm* — Rankin, Hill & Clark LLP

(57) ABSTRACT

A flat conductor electric connector mounted on a circuit board and electrically connected to a front end side portion of a band-shaped flat conductor extending in a front-back direction, comprising: multiple terminals in such a shape that metal plate members are bent in a plate thickness direction thereof; and a housing holding, by insert molding, the multiple terminals arrayed in a terminal array direction which is a band width direction, wherein each of the multiple terminals has, at least at one end portion in the front-back direction, a holding target portion held on the housing and an extending portion extending from the housing and formed with a mounting portion to be mounted on the circuit board by soldering, and the holding target portions adjacent to each other and the extending portions adjacent to each other are arrayed and positioned in the terminal array direction. The mounting portion includes an opening to receive a pin of a molding device.

4 Claims, 10 Drawing Sheets

(56) References Cited

U.S. PATENT DOCUMENTS 5,201,662 A * 4/1993 Roche ..... H01R 12/716 439/377
5,241,134 A * 8/1993 Yoo ..... H01L 23/49541 439/876
5,281,152 A * 1/1994 Takahashi ..... H01R 12/716 439/876
5,713,126 A * 2/1998 Sakemi ..... H05K 3/3426 439/62
5,904,581 A * 5/1999 Pope ..... H01R 24/60 439/74
6,280,204 B1 * 8/2001 Funatsu ..... H01R 12/725 439/876
7,112,087 B2 * 9/2006 Tago ..... H01R 13/6581 439/495
7,270,567 B2 * 9/2007 Inoue ..... H01R 12/79 439/495
7,695,295 B2 * 4/2010 Hanyu ..... H01R 12/774 439/153
7,976,319 B2 * 7/2011 Nguyen ..... H01R 12/57 439/876
8,298,001 B2 * 10/2012 Ashibu ..... H01R 12/88 439/495
8,622,766 B2 * 1/2014 Yokoo ..... H01R 12/775 439/495
8,651,885 B2 * 2/2014 Ashibu ..... H01R 12/774 439/328
8,662,916 B2 * 3/2014 Ashibu ..... H01R 12/88 439/495
8,939,790 B2 * 1/2015 Jung ..... H01R 12/774 439/495
9,859,639 B2 * 1/2018 Tagami ..... H01R 12/88
10,868,374 B2 * 12/2020 Mizusawa ..... H01R 12/79
11,201,425 B2 * 12/2021 Mizusawa ..... H01R 12/7058
11,557,858 B2 * 1/2023 Hetrick ..... H01R 13/6275
2011/0244709 A1 * 10/2011 Ashibu ..... H01R 12/774 439/372
2022/0149551 A1 * 5/2022 Yamaguchi ..... H01R 12/88

* cited by examiner

ELECTRIC CONNECTOR FOR FLAT CONDUCTOR

CROSS-REFERENCE TO RELATED APPLICATION

This application claims priority from Japanese Patent Application No. 2020-186072 filed with the Japan Patent Office on Nov. 6, 2020, the entire content of which is hereby incorporated by reference.

BACKGROUND

1. Technical Field

The present invention relates to a flat conductor electric connector mounted on a circuit board and connected to a flat conductor.

2. Related Art

A flat conductor extending in a front-back direction parallel with a surface of a circuit board is connected to a flat conductor electric connector as described above in a state in which the flat conductor electric connector is mounted on the circuit board. This connector is configured such that mounting portions of multiple terminals held on a housing are mounted on the circuit board by soldering in a state in which the mounting portions are arrayed on the circuit board. Normally, many terminals are arrayed, and for this reason, mounting portions thereof are required to be densely positioned for reduction in the size of the connector in a terminal array direction.

For example, a connector of JP-UM-A-61-194263 has been known as the flat conductor electric connector configured such that the mounting portions of the terminals are densely arrayed. In JP-UM-A-61-194263, the connector is manufactured in such a manner that a semi-processed product of terminals ("contacts" in JP-UM-A-61-194263) extending in a comb tooth shape is formed from a carrier (a coupling piece) obtained by punching of a metal plate and the carrier is cut and removed from the terminals after each terminal of the semi-processed product has been held on a housing.

For such a connector, when an attempt is made to densely array the terminals, there are problems such as a problem that with only the single semi-processed product, a sufficient clearance for a punching blade cannot be ensured between the terminals. In Patent Literature 1, two semi-processed products are used, and the terminals are densely arrayed in such a manner that both semi-processed products are, at carriers thereof, fixed to each other with the semi-processed products being shifted from each other by a half pitch of the terminal and the carriers are cut after these semi-processed products have been held on the housing.

SUMMARY

A flat conductor electric connector mounted on a circuit board and electrically connected to a front end side portion of a band-shaped flat conductor extending in a front-back direction, comprising:

multiple terminals in such a shape that metal plate members are bent in a plate thickness direction thereof; and a housing holding, by insert molding, the multiple terminals arrayed in a terminal array direction which is a band width direction, wherein each of the multiple terminals has, at least at one end portion in the front-back direction, a holding target portion held on the housing and an extending portion extending from the housing and formed with a mounting portion to be mounted on the circuit board by soldering, and the holding target portions adjacent to each other are arrayed and positioned in the terminal array direction with areas overlapping with each other in the front-back direction and the extending portions adjacent to each other are arrayed and positioned in the terminal array direction with areas overlapping with each other in the front-back direction, the extending portion includes one extending portion or multiple extending portions separated from each other in the terminal array direction and has, at least at an end portion positioned outside the housing in the front-back direction and positioned on a housing side, a narrow portion of which a terminal width in the terminal array direction is narrower than a terminal width of the holding target portion, and an opening is formed by the narrow portion, and a clearance between a narrow portion of an optional extending portion and another extending portion adjacent to the narrow portion of the optional extending portion with respect to an opening is greater than a clearance between adjacent ones of the holding target portions.

DETAILED DESCRIPTION

Figure 1A:
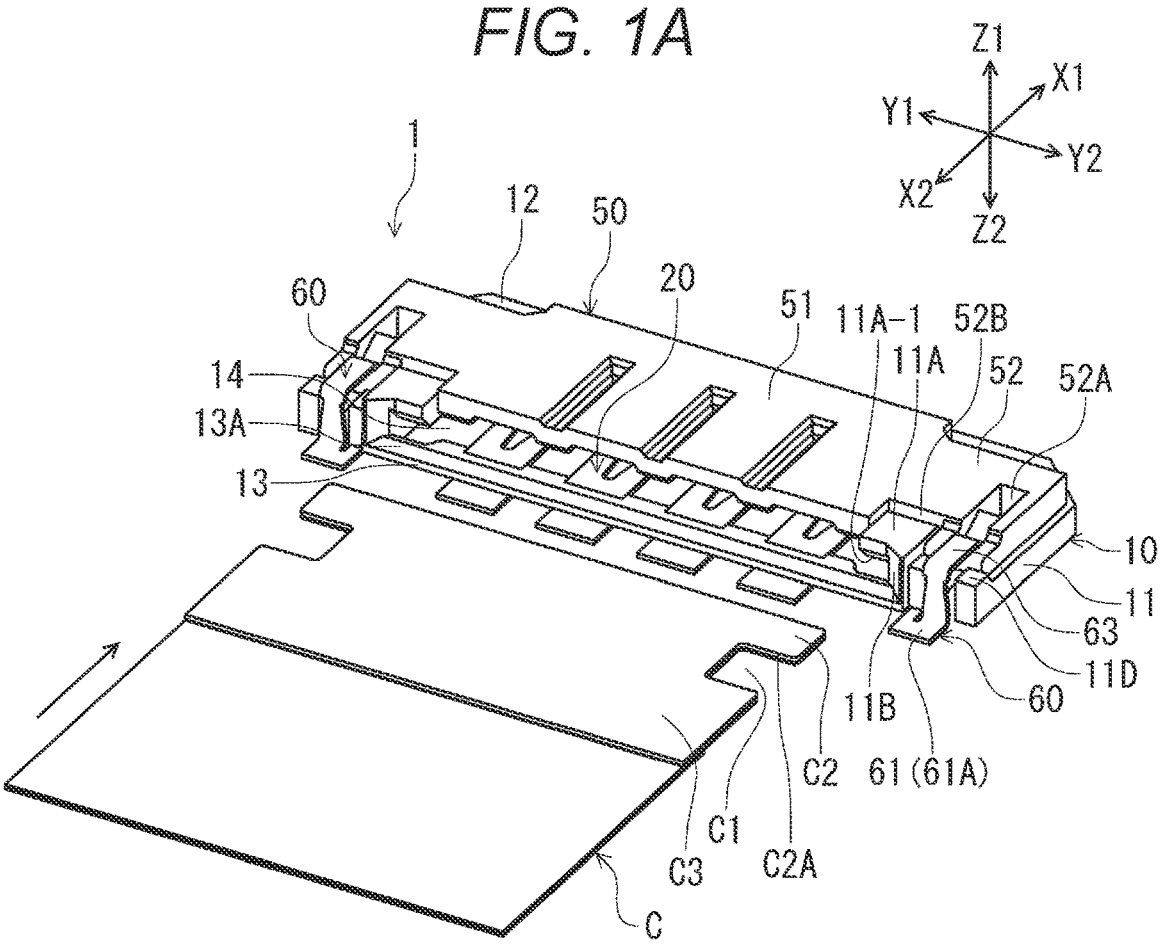
FIGS. 1A and 1B show perspective views of a flat conductor electric connector according to an embodiment of the present invention together with a flat conductor, FIG. 1A showing a state before insertion of the flat conductor and FIG. 1B showing a state after insertion of the flat conductor.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In recent years, in a connector configured such that terminals are densely arrayed, the terminals are held on a housing by insert molding in many cases. Generally, for such a connector, a small clearance between the terminals needs to be reliably ensured with favorable accuracy so that the housing can be molded and the terminals can be densely positioned. A member (a die pin) such as a pin of a molding die is arranged between the terminals. However, when an attempt is made to hold the terminals by insert molding in the connector of Patent Literature 1, the clearance between the terminals is extremely small, and for this reason, the die pin cannot be arranged or the strength thereof cannot be obtained because the die pin is extremely thin. Nevertheless, when the clearance between the terminals is increased, the original purpose that the terminals are densely arrayed cannot be achieved.

The present invention has been made in view of such a situation, and an object of the present invention is to provide a flat conductor electric connector capable of ensuring the strength of a die pin of a molding die for holding terminals by insert molding while the terminals are densely arrayed.

The flat conductor electric connector according to the present invention is a flat conductor electric connector mounted on a circuit board and electrically connected to a front end side portion of a band-shaped flat conductor extending in a front-back direction, the flat conductor electric connector including multiple terminals in such a shape that metal plate members are bent in a plate thickness direction thereof and a housing holding, by insert molding, the multiple terminals arrayed in a terminal array direction which is a band width direction.

In such a flat conductor electric connector, in the present invention, each of the multiple terminals has, at least at one end portion in the front-back direction, a holding target portion held on the housing and an extending portion extending from the housing and formed with a mounting portion to be mounted on the circuit board by soldering, and the holding target portions adjacent to each other are arrayed and positioned in the terminal array direction with areas overlapping with each other in the front-back direction and the extending portions adjacent to each other are arrayed and positioned in the terminal array direction with areas overlapping with each other in the front-back direction. The extending portion includes one extending portion or multiple extending portions separated from each other in the terminal array direction and has, at least at an end portion positioned outside the housing in the front-back direction and positioned on a housing side, a narrow portion of which the terminal width in the terminal array direction is narrower than the terminal width of the holding target portion, and an opening is formed by the narrow portion. A clearance between a narrow portion of an optional extending portion and another extending portion adjacent to the narrow portion of the optional extending portion with respect to an opening is greater than a clearance between adjacent ones of the holding target portions.

In the present invention, the opening is formed by the narrow portion of the extending portion of the terminal so that a die pin of a molding die can enter the opening. Thus, even when the terminals are arrayed with a narrow clearance therebetween in the terminal array direction, it is not necessary to thinly form the die pin, and the die pin with a sufficient strength can be arranged upon insert molding of the terminals and the housing.

In the present invention, the opening of each terminal may be formed as a recessed portion at a side edge of the extending portion.

In the present invention, each terminal may have a first terminal member and a second terminal member sandwiching the flat conductor in a thickness direction thereof, a first extending portion of the first terminal member and a second extending portion of the second terminal member may form the extending portion, and the narrow portion may be formed at least at one of the first extending portion or the second extending portion.

In the present invention, in a case where the terminal has the first terminal member and the second terminal member, openings may be, at a side edge of the first extending portion and a side edge of the second extending portion, formed by recessed portions facing each other in the terminal array direction. With this configuration, the opposing recessed portions of the first and second extending portions together form a single large opening space so that a thick die pin can enter such a space.

Advantageous Effects of Invention

According to the present invention, the opening is formed by the narrow portion of the extending portion of the terminal so that the die pin of the molding die can enter such an opening. Thus, the die pin with a sufficient strength can be used without the need for narrowing the entire area of the terminal and increasing a terminal array pitch, and the terminals can be densely arrayed while the terminals are held at proper positions.

Hereinafter, an embodiment of the present invention will be described based on the attached drawings.

Figure 1B:
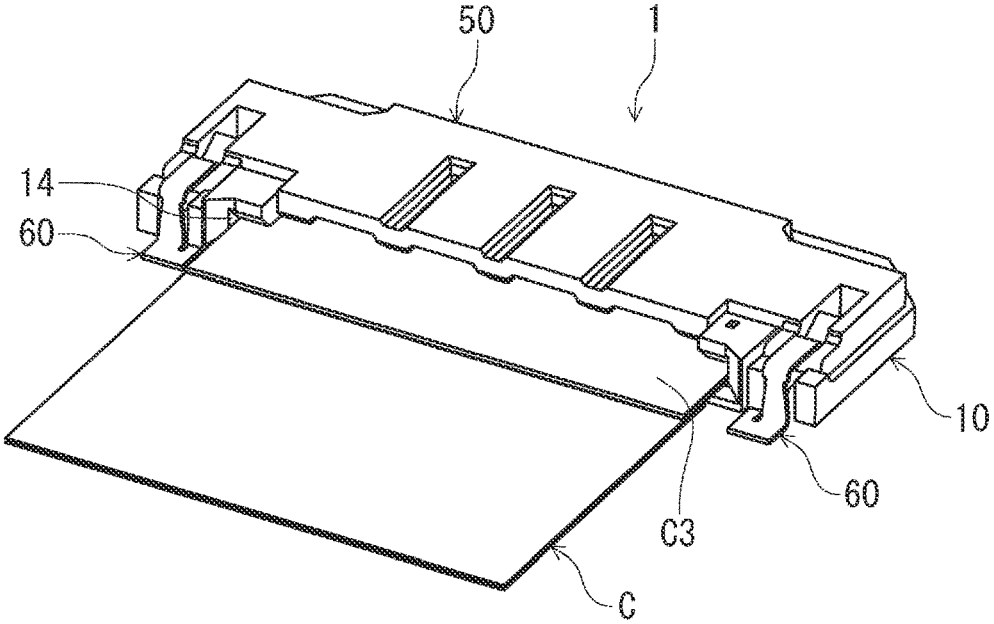

FIGS. 1A and 1B are perspective views showing an electric connector 1 (hereinafter referred to as a "connector 1") according to the present embodiment together with a flat conductor C as a partner connection body, FIG. 1A showing a state before insertion of the flat conductor C and FIG. 1B showing a state after insertion of the flat conductor C.

The connector 1 is a flat conductor electric connector arranged on a mounting surface of a circuit board (not shown) and connected to the flat conductor C such that the above-described circuit board and the flat conductor C are brought into electric conduction with each other. The flat conductor C is in a band shape extending in a front-back direction (an X-axis direction) as shown in FIGS. 1A and 1B, and a front end side portion of the flat conductor C is connected to the connector 1. In the present embodiment, an X1 direction is the front, and an X2 direction is the back. In the flat conductor C, multiple circuit portions (not shown) extending in the front-back direction in an insulating layer of the flat conductor C are arrayed in a band width direction (a Y-axis direction) of the flat conductor C, and reach a front end (tip end) position of the flat conductor C. Front end side portions of these circuit portions are exposed at one surface, i.e., a lower surface, of the flat conductor C, and are contactable with later-described terminals 20 of the connector 1. Cutout portions C1 are formed at both side edges of the above-described front end side portion, and a back end edge of an ear portion C2 positioned at the front of the cutout portion C1 functions as a locking target portion C2A to be locked at a locking portion 54 of a movable member 50 of the connector 1 as described later (see FIG. 6A). Moreover, a reinforcing plate C3 is bonded to the other surface, i.e., an upper surface, of the front end side portion of the flat conductor C.

The connector 1 includes a housing 10 extending in a longitudinal direction as a connector width direction (the Y-axis direction) parallel with the mounting surface of the circuit board (not shown) and perpendicular to the front-back direction and made of an electric insulating material, the multiple metal terminals 20 held on the housing 10 in a terminal array direction as the connector width direction, the movable member 50 supported on the housing 10 to move (turn) between a closed position and an open position as described later and made of an electric insulating material, and metal fittings 60 held at both end portions of the housing 10 in the terminal array direction. The front end side portion of the flat conductor C is, from the back side (the X2 side), inserted into and connected to the connector 1 (see an arrow of FIG. 1A). Moreover, in the present embodiment, the terminal 20 is used as a power supply terminal. As described later, the terminal 20 has a first arm member 30 as a first arm portion and a second arm member 40 as a second arm portion, the first arm member 30 and the second arm member 40 being separate metal plate members.

As shown in FIGS. 1A to 3, the housing 10 has side walls 11 positioned on both end sides in the terminal array direction (the Y-axis direction) and extending in the front-back direction (the X-axis direction), a front wall 12 (see FIG. 3) extending in the terminal array direction to couple front end portions of the two side walls 11, and a back wall 13 extending in the terminal array direction to couple back end portions of the two side walls 11. A space surrounded by the two side walls 11 and the front wall 12 and opening backward forms a receiving portion 14 which can receive the front end side portion of the flat conductor C from the back.

The side wall 11 has a guide portion 11A extending, at a position close to a back end of the side wall 11, inward from an upper portion of the side wall 11 in the terminal array direction. The guide portion 11A is provided at a position with a clearance from the back wall 13 in an upper-lower direction (a Z-axis direction). The dimension of such a clearance in the upper-lower direction is slightly greater than the thickness dimension (the dimension in the upper-lower direction) of the flat conductor C, and entrance of side edge portions (both end side portions in the Y-axis direction) of the flat conductor C into the receiving portion 14 from the back is allowed by the above-described clearance. An upper guide surface 11A-1 inclined downward toward the front is formed at a lower surface of a back end portion of the guide portion 11A, and guides the side edge portion of the flat conductor C into the receiving portion 14.

Moreover, a side guide surface 11B is formed at the back end portion of the side wall 11. The side guide surface 11B forms an inclined surface inclined inward in the connector width direction toward the front, and guides the side edge portion of the flat conductor C into the receiving portion 14.

Further, a side groove portion 11C penetrating the side wall 11 in the upper-lower direction at an intermediate position in the terminal array direction and opening backward is formed at a back half portion of the side wall 11. The side groove portion 11C is, corresponding to a later-described restriction arm portion 63 of the metal fitting 60, positioned below a later-described horizontal arm portion 63B of the restriction arm portion 63 in the terminal array direction (see FIG. 2B). Moreover, back protruding portions 11D protruding upward on both sides of the side groove portion 11C are formed at the back end portion of the side wall 11. A front surface of each back protruding portion 11D forms a curved surface recessed in an arc shape, and such a curved surface is formed as a support surface 11D-1 turnably supporting a later-described turning shaft portion 53 of the movable member 50 (see FIGS. 7A to 7C).

The front wall 12 has the function of a front holding portion holding, by insert molding (integral molding), later-described first front holding target portions 32 of the first arm members 30 of the terminals 20 and later-described second holding target portions 42 of the second arm members 40 of the terminals 20. At the front wall 12, support protruding portions 12A protruding backward from a back surface of an upper portion of the front wall 12 are formed at positions corresponding to the terminals 20 in the terminal array direction. As described later, the support protruding portion 12A supports a later-described coupling portion 43 of the second arm member 40 in contact with a front surface of the coupling portion 43 (see FIGS. 5A and 6B).

Figure 5A:
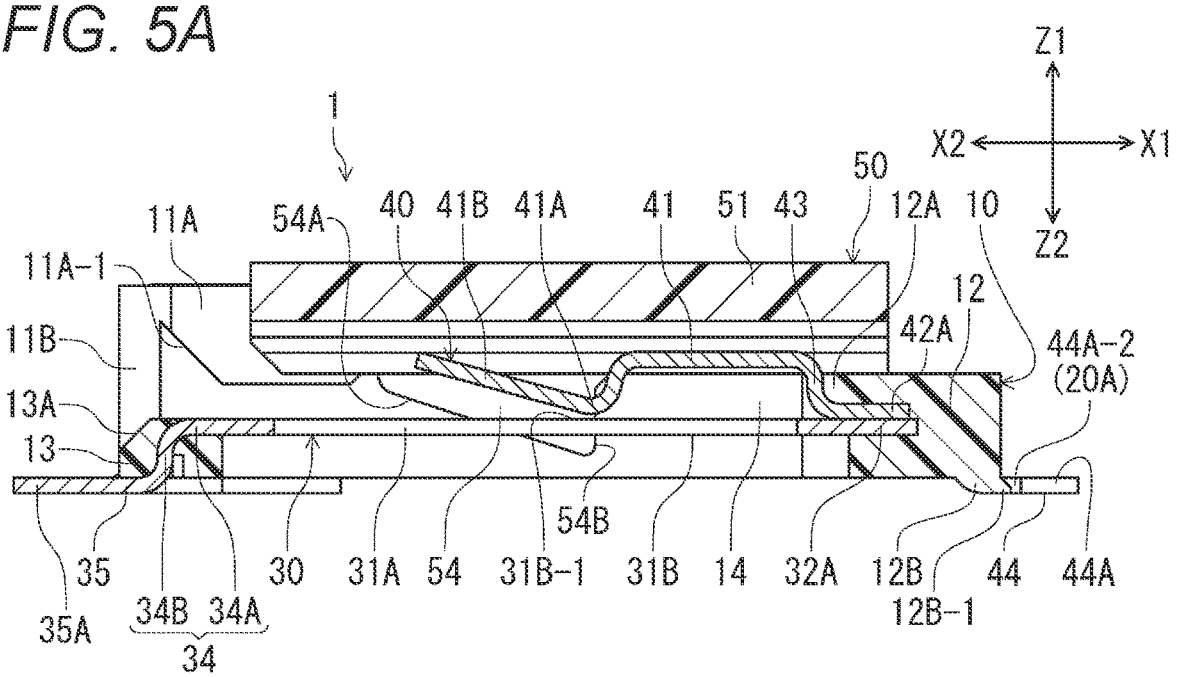
FIG. 5A shows a longitudinal sectional view of the flat conductor electric connector at the position of a slit of the first arm member in a terminal array direction.
Figure 5B:
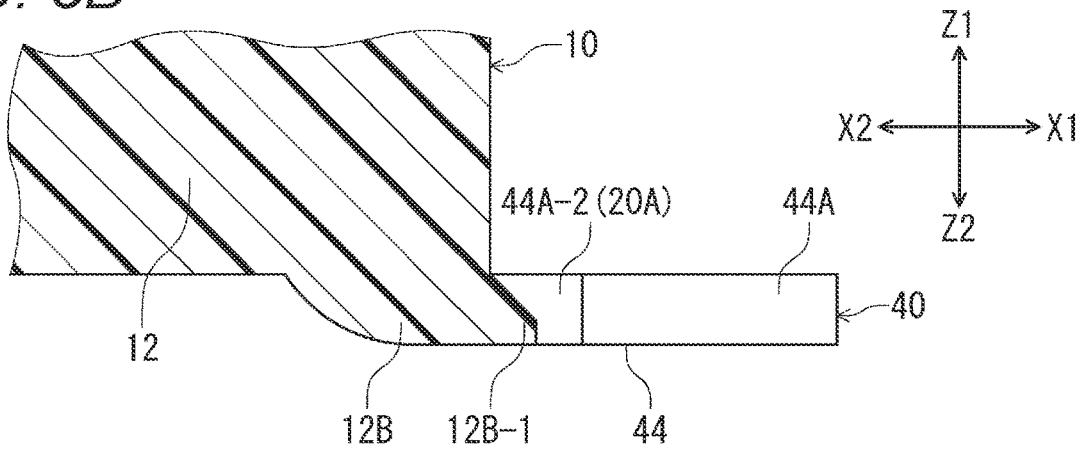
FIG. 5B shows a partially-enlarged view of FIG. 5A.
Figure 5C:
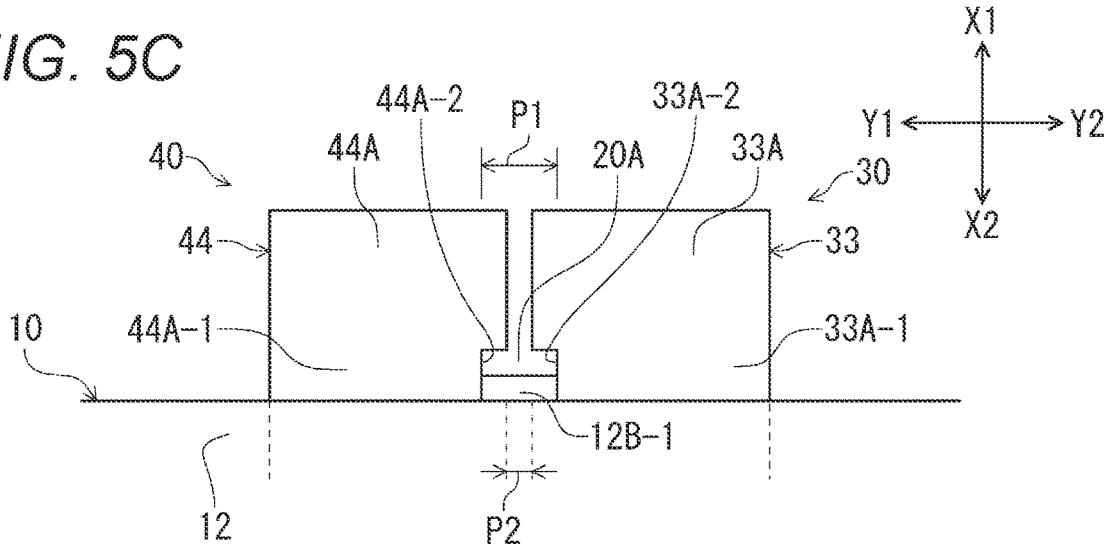
FIG. 5C shows a plan view of a mounting portion of the terminal of the flat conductor electric connector of FIG. 5A.

Moreover, as shown in FIGS. 5A to 5C, a lower protruding portion 12B protruding downward from a lower surface of a front end portion of the front wall 12 and extending forward is, at the front wall 12, formed at a position corresponding to a position between a later-described first forward-extending portion 33 and a later-described second extending portion 44 of each terminal 20. The lower protruding portion 12B is formed with the same dimensions as those of the first forward-extending portion 33 and the second extending portion 44 in the upper-lower direction. A lower surface of the lower protruding portion 12B is positioned at the same height as that of a lower surface of each of the first forward-extending portion 33 and the second extending portion 44, and is surface-contactable with the mounting surface of the circuit board (not shown). The lower protruding portion 12B has a front end protruding portion 12B-1 protruding forward beyond a front surface of the front wall 12.

As shown in FIGS. 5A to 5C, the front end protruding portion 12B-1 extends to an intermediate position in the front-back direction in a later-described pin insertable space 20A formed between a first recessed portion 33A-2 of a first front mounting portion 33A as described later and a second recessed portion 44A-2 of a second mounting portion 44A as described later. Moreover, an upper surface of the front end protruding portion 12B-1 forms an inclined surface inclined downward toward the front.

The back wall 13 has the function of a back holding portion holding, by insert molding, later-described first back holding target portions 34 of the first arm members 30. As shown in FIG. 5A, a lower guide surface 13A inclined upward toward the front is formed at an upper surface of a back end portion of the back wall 13, and guides the front end portion of the flat conductor C into the receiving portion 14.

Figure 4A:
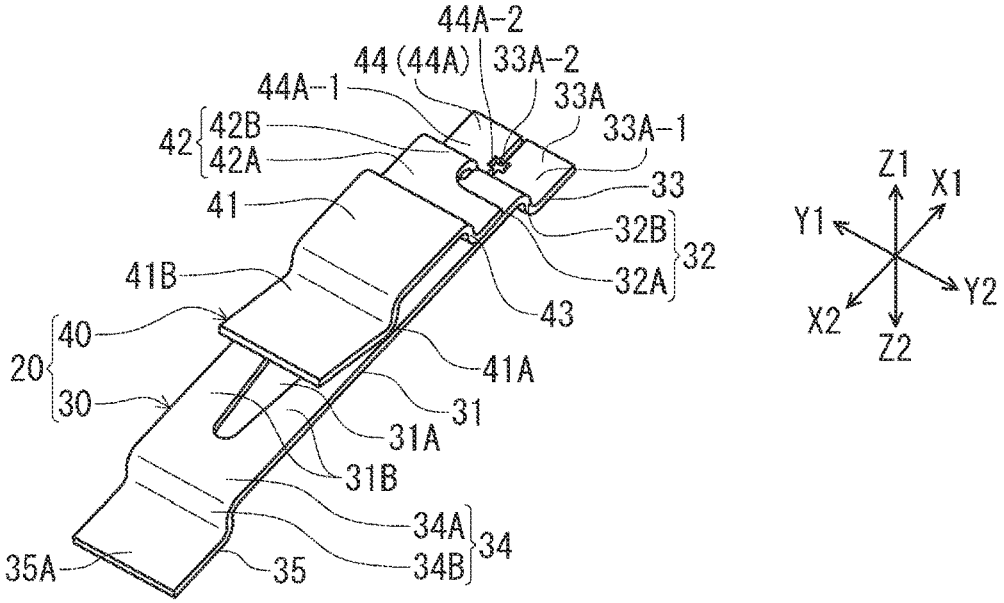
FIG. 4A shows a perspective view of a terminal in a state in which a first arm member and a second arm member overlap with each other.
Figure 4B:
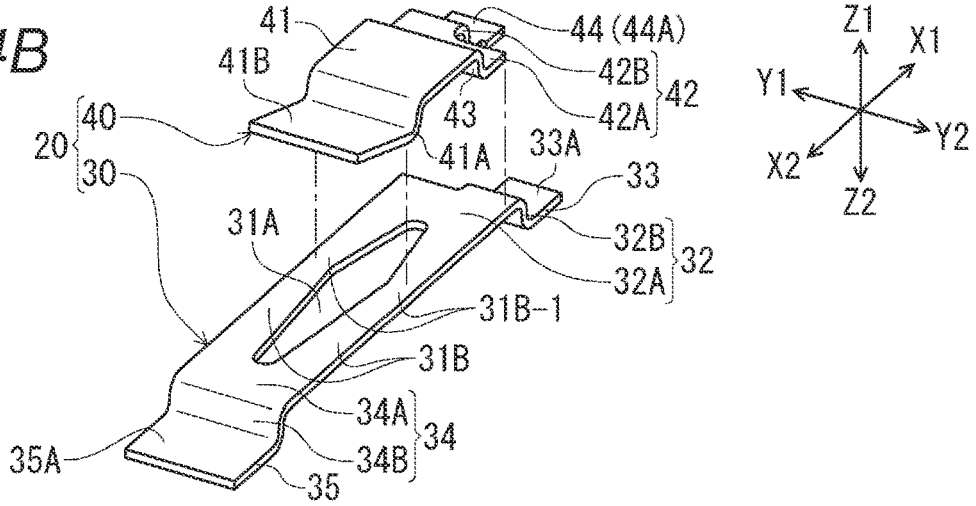
FIG. 4B shows a perspective view of the first and second arm members separated from each other.

The terminal 20 has the first arm member 30 as the first arm portion and the second arm member 40 as the second arm portion, the first arm member 30 and the second arm member 40 being the separate members. Since the terminal is formed of two members as described above, it is not necessary to perform bending for folding back a metal plate member upon manufacturing of the terminal, and therefore, the terminal is easily manufactured and a material yield is improved. FIG. 4A is a perspective view showing the terminal 20 in a state in which the first arm member 30 and the second arm member 40 overlap with each other, and FIG. 4B is a perspective view showing the first and second arm members 30, 40 separated from each other. The first arm member 30 and the second arm member 40 are formed in such a manner that band-shaped metal plate members extending in the front-back direction are bent in a plate thickness direction.

The first arm member 30 has a first contact arm portion 31 linearly extending across an area between the front wall 12 and the back wall 13 in the front-back direction, the first front holding target portion 32 extending in a substantially lying L-shape from a front end of the first contact arm portion 31 and held on the front wall 12, the first forward-extending portion 33 extending forward from a lower end of the first front holding target portion 32, the first back holding target portion 34 extending in a substantially lying L-shape from a back end of the first contact arm portion 31 and held on the back wall 13, and a first backward-extending portion 35 extending backward from a back end of the first back holding target portion 34. As shown in FIGS. 4A and 4B, the first arm member 30 is configured such that a later-described first front vertical portion 32B of the first front holding target portion 32 and the first forward-extending portion 33 are, with a terminal width (a dimension in the terminal array direction) of the substantially half of the terminal width of other portions of the first arm member 30, formed on a Y2 side at the first arm member 30.

Figure 3:
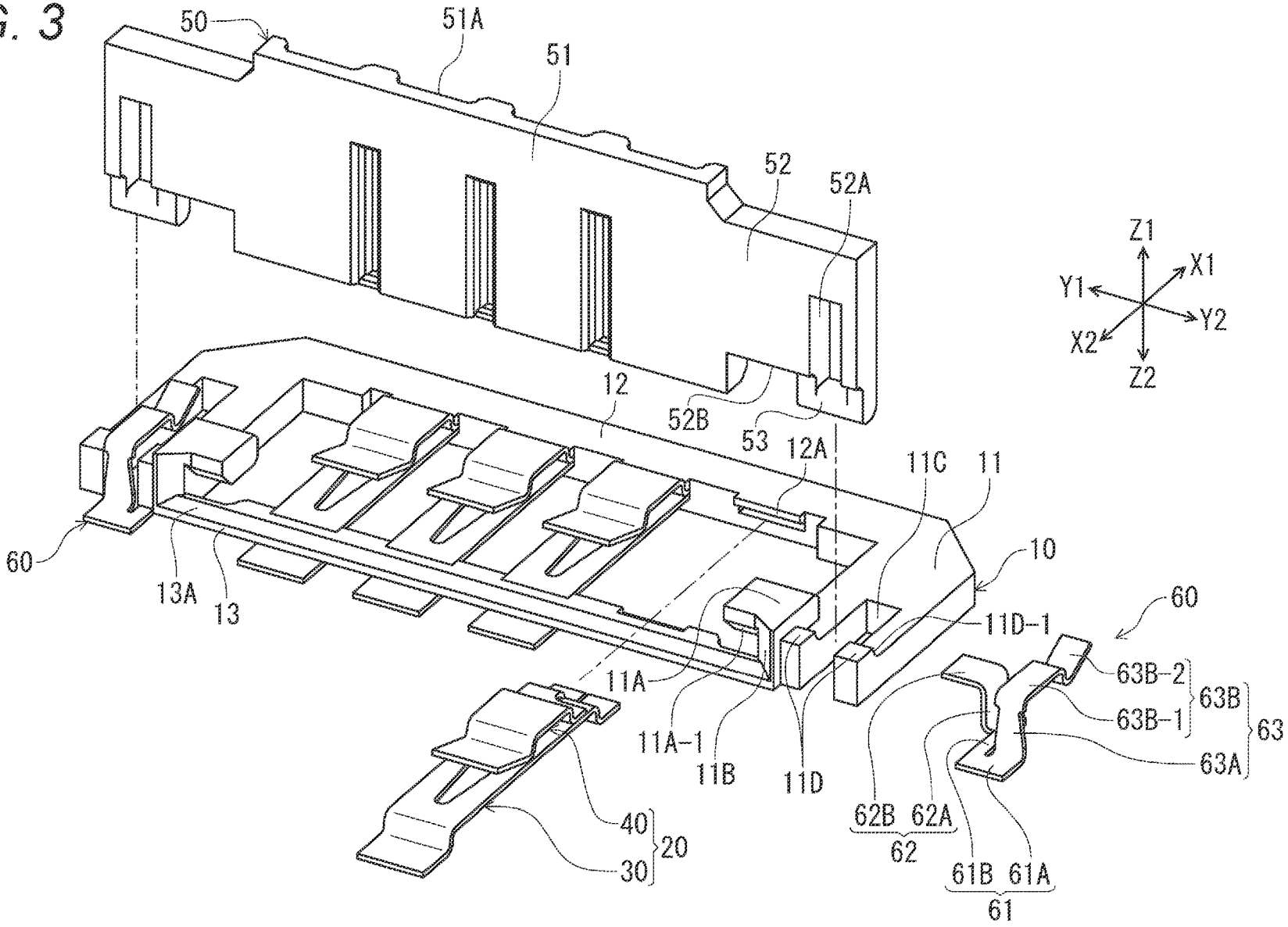
FIG. 3 shows a perspective view of each member of the flat conductor electric connector of FIGS. 1A and 1B in a separated state.

As shown in FIG. 3, the first contact arm portion 31 extends across an area between a back end surface of the front wall 12 and a front end surface of the back wall 13 in the front-back direction in a posture in which the upper-lower direction is the plate thickness direction, and is exposed through the housing 10. A window-shaped slit 31A penetrating the first contact arm portion 31 in the upper-lower direction and extending in the front-back direction is formed at the first contact arm portion 31, and contact stripe portions 31B extending in the front-back direction and formed elastically displaceable in the upper-lower direction are formed at positions on both sides of the slit 31A in the terminal array direction.

In the present embodiment, the slit 31A is, as shown in FIG. 4B, in a substantially diamond shape of which the longitudinal direction is the front-back direction. Thus, the contact stripe portion 31B positioned on each side of the slit 31A has the minimum terminal width at an intermediate position (a position at which the width dimension of the slit 31A in the terminal array direction is maximum) in the front-back direction, and has the maximum terminal width at a front end position and a back end position. A portion of the contact stripe portion 31B with the minimum terminal width is formed as a first contact portion 31B-1 contactable with a lower surface of the front end side portion of the flat conductor C with contact pressure. In the present embodiment, the circuit portions are exposed at the lower surface of the front end side portion of the flat conductor C, and the first contact portions 31B-1 function as contact portions configured to contact and be electrically connected to the above-described circuit portions.

In the present embodiment, since the slit 31A is formed at the first contact arm portion 31, the two first contact portions 31B-1 are provided at the single first contact arm portion 31 so that the reliability of contact with the flat conductor C can be improved. Moreover, since each contact stripe portion 31B is thinner than the entirety of the first contact arm portion 31 and is easily elastically displaceable, the flat conductor C is easily inserted into a portion among the first contact portions 31B-1 and a later-described second contact portion 41A. Further, as described above, since the contact stripe portion 31B has the minimum terminal width at the position of the first contact portion 31B-1, the contact stripe portion 31B is easily elastically displaceable in the upper-lower direction at the position of the first contact portion 31B-1 upon contact with the above-described circuit portion. Moreover, since the contact stripe portion 31B has the maximum terminal width at the front end position and the back end position, the strength of the contact stripe portion 31B can be ensured at these positions.

The first front holding target portion 32 is formed bent in the plate thickness direction to form the substantially lying L-shape as viewed in the terminal array direction, and is held on the front wall 12 by insert molding. The first front holding target portion 32 has a first front horizontal portion 32A as a first base portion extending forward from the front end of the first contact arm portion 31 and the first front vertical portion 32B bent at a front end of a Y2-side portion of the first front horizontal portion 32A and extending downward.

In the present embodiment, as shown in FIG. 4B, the first front horizontal portion 32A is formed with the same terminal width as that of the first contact arm portion 31, but the first front vertical portion 32B is formed with a terminal width of the substantially half of the terminal width of the first contact arm portion 31 at a position close to the Y2 side in the terminal array direction. The first front horizontal portion 32A and the first front vertical portion 32B are embedded in the front wall 12.

At a position below a lower surface of the front wall 12 (excluding the lower protruding portions 12B), the first forward-extending portion 33 is bent at a lower end of the first front vertical portion 32B, and extends forward. The first forward-extending portion 33 is positioned within the area of the front wall 12 in the front-back direction, extends along the lower surface of the front wall 12, and further extends forward beyond the front surface of the front wall 12. The first forward-extending portion 33 is positioned in the area of the first front horizontal portion 32A as the first base portion in the terminal array direction. Of the first forward-extending portion 33, a portion positioned at the front of the front wall 12 is formed as the first front mounting portion 33A mounted on the mounting surface of the circuit board by soldering. When the connector 1 is arranged on the mounting surface of the circuit board, the first front mounting portion 33A surface-contacts the corresponding circuit portion (not shown) of the circuit board at a lower surface of the first front mounting portion 33A, and is connectable to the corresponding circuit portion by soldering.

As shown in FIG. 5C, the first front mounting portion 33A is formed with a first narrow portion 33A-1 at a back end portion, i.e., an end portion positioned on a front wall 12 side. A side edge of the first narrow portion 33A-1 extending in the front-back direction on a Y1 side is positioned recessed to the Y2 side with respect to a Y1-side edge of other portions of the first forward-extending portion 33.

With this configuration, the first narrow portion 33A-1 has a smaller terminal width than that of the other portions of the first forward-extending portion 33. At the first front mounting portion 33A, the first recessed portion 33A-2 as an opening is formed on the Y1 side of the above-described back end portion by the first narrow portion 33A-1. That is, the first recessed portion 33A-2 is in such a shape that the Y1-side edge of the back end portion of the first front mounting portion 33A as described above is cut out in a rectangular shape, and opens to the Y1 side. As shown in FIG. 5C, a back end of the first narrow portion 33A-1, i.e., a back end of the first recessed portion 33A-2, is at the same position as that of the front surface of the front wall 12 in the front-back direction.

As shown in FIGS. 4A and 4B, the first back holding target portion 34 extends with the same terminal width as that of the first contact arm portion 31 from the back end of the first contact arm portion 31. As shown in FIG. 5A, the first back holding target portion 34 is formed bent in the plate thickness direction to form the substantially lying L-shape as viewed in the terminal array direction, and is held on the back wall 13 by insert molding. The first back holding target portion 34 has a first back horizontal portion 34A extending backward from the back end of the first contact arm portion 31 and a first back vertical portion 34B bent at a back end of the first back horizontal portion 34A and extending downward. In the present embodiment, as shown in FIG. 5A, the first back horizontal portion 34A and the first back vertical portion 34B are positioned inside the back wall 13, and are embedded in the back wall 13.

The first backward-extending portion 35 is bent at a lower end of the first back vertical portion 34B, and extends backward. The first backward-extending portion 35 is positioned within the area of the back wall 13 in the front-back direction, extends along a lower surface of the back wall 13, and further extends backward beyond a back surface of the back wall 13. Of the first backward-extending portion 35, a portion positioned at the back of the back wall 13 is formed as a first back mounting portion 35A mounted on the mounting surface of the circuit board by soldering. When the connector 1 is arranged on the mounting surface of the circuit board, the first back mounting portion 35A surface-contacts the corresponding circuit portion (not shown) of the circuit board at a lower surface of the first back mounting portion 35A, and is connectable to the corresponding circuit portion by soldering.

The second arm member 40 has a second contact arm portion 41 extending in the front-back direction, the second holding target portion 42 positioned at the front of the second contact arm portion 41 and held on the front wall 12, the coupling portion 43 extending in the upper-lower direction to couple a front end of the second contact arm portion 41 and a back end of the second holding target portion 42 to each other, and the second extending portion 44 extending forward from a lower end of the second holding target portion 42. As shown in FIGS. 4A and 4B, the second arm member 40 is configured such that a later-described second vertical portion 42B of the second holding target portion 42 and the second extending portion 44 are, with a terminal width (a dimension in the terminal array direction) of the substantially half of the terminal width of other portions of the second arm member 40, formed on the Y1 side at the second arm member 40.

The second contact arm portion 41 extends, above the first contact arm portion 31 of the first arm member 30, backward from a back end position of the front wall 12 at a position apart from the first contact arm portion 31. The second contact arm portion 41 has the same terminal width as that of the first contact arm portion 31, and is at the same position as that of the first contact arm portion 31 in the terminal array direction. As shown in FIGS. 5A and 6B, a back end (a free end) of the second contact arm portion 41 is positioned among the first contact portions 31B-1 of the first contact arm portion 31 and the back end of the first contact arm portion 31 in the front-back direction. At the second contact arm portion 41, the second contact portion 41A protruding downward at the same position as that of the first contact portion 31B-1 in the front-back direction is formed by bending of the second contact arm portion 41 in the plate thickness direction. The dimension of a clearance formed by the first contact portion 31B-1 and the second contact portion 41A in the upper-lower direction is smaller than the thickness dimension of the flat conductor C. Moreover, a portion of the second contact arm portion 41 from the second contact portion 41A to a back end is formed as a back end inclined portion 41B inclined upward toward the back.

As shown in FIG. 4B, the second holding target portion 42 is formed bent in the plate thickness direction to form a substantially lying L-shape as viewed in the terminal array direction, and is held on the front wall 12 by insert molding. The second holding target portion 42 has a second horizontal portion 42A as a second base portion extending forward from a lower end of the coupling portion 43 and the second vertical portion 42B bent at a front end of a Y1-side portion of the second horizontal portion 42A and extending downward.

In the present embodiment, as shown in FIG. 4B, the second horizontal portion 42A is formed with the same terminal width as that of the second contact arm portion 41, but the second vertical portion 42B is, with a terminal width of the substantially half of the terminal width of the second contact arm portion 41, formed at a position close to the Y1 side in the terminal array direction. The second horizontal portion 42A and the second vertical portion 42B are embedded in the back wall 13.

The second horizontal portion 42A has the same terminal width as that of the first front horizontal portion 32A of the first arm member 30, and is at the same position as that of the first front horizontal portion 32A in the terminal array direction. Moreover, a portion from the second horizontal portion 42A to the back end of the second contact arm portion 41 has the same terminal width as that of a portion from the first front horizontal portion 32A to the back end of the first contact arm portion 31, and is at the same position as that of such a portion in the terminal array direction. With this configuration, the multiple terminals 20 can be densely arrayed, and as a result, reduction in the size of the connector 1 in the terminal array direction is achieved. The phrase "densely arrayed" as described herein means that the first arm member 30 and the second arm member 40 are arrayed close to each other such that a clearance (indicated by "P2" in FIG. 5C) between portions (dashed portions in FIG. 5C) of the first forward-extending portion 33 and the second extending portion 44 positioned at the back of the front surface of the front wall 12 of the housing 10 is as small as possible.

The second vertical portion 42B has the same terminal width as that of the first front vertical portion 32B of the first arm member 30, is at the same position as that of the first front vertical portion 32B in the front-back direction and the upper-lower direction, and is positioned differently from the first front vertical portion 32B and is adjacent to the first front vertical portion 32B in the terminal array direction.

As shown in FIG. 5A, the second horizontal portion 42A surface-contacts, at a lower surface thereof, an upper surface of the first front horizontal portion 32A of the first arm member 30, and can be in electric conduction with the first front horizontal portion 32A. As described above, in the present embodiment, the first front horizontal portion 32A and the second horizontal portion 42A are held on the front wall 12 in a state in which the first front horizontal portion 32A and the second horizontal portion 42A overlap with and surface-contact each other in the upper-lower direction, and therefore, the dimension of the connector 1 in the upper-lower direction can be reduced and reduction in the size in the upper-lower direction, i.e., reduction in the height, can be achieved.

Moreover, in the present embodiment, as shown in FIG. 5A, the second horizontal portion 42A is, at an upper surface thereof, supported on the front wall 12. Thus, when the flat conductor C enters the portion among the first contact portions 31B-1 and the second contact portion 41A and the second contact arm portion 41 is elastically displaced upward, the second horizontal portion 42A can resist force acting on the second horizontal portion 42A in an elastic displacement direction, i.e., the upward force of separating the second horizontal portion 42A from the first front horizontal portion 32A, and separation of the first front horizontal portion 32A and the second horizontal portion 42A can be prevented. Thus, a sufficiently-great contact pressure on the flat conductor C for sandwiching the flat conductor C by the first contact portions 31B-1 and the second contact portion 41A can be more reliably ensured.

As shown in FIGS. 5A and 6B, the coupling portion 43 has the same terminal width as those of the second contact arm portion 41 and the second horizontal portion 42A, is bent upward at a back end of the second horizontal portion 42A, and is coupled to the front end of the second contact arm portion 41. The coupling portion 43 extends along a back surface of the support protruding portion 12A of the front wall 12, i.e., a protruding top surface of the support protruding portion 12A, at a position at the back of the front wall 12. The front surface of the coupling portion 43 is supported on the back surface of the support protruding portion 12A.

The front surface of the coupling portion 43 is supported on the back surface of the support protruding portion 12A as described above. Thus, when the flat conductor C enters the portion among the first contact portions 31B-1 and the second contact portion 41A and the second contact arm portion 41 is elastically displaced upward, the coupling portion 43 can resist force acting on the coupling portion 43 and having a forward component, and as a result, separation of the first front horizontal portion 32A and the second horizontal portion 42A can be prevented. Thus, a sufficiently-great contact pressure on the flat conductor C for sandwiching the flat conductor C by the first contact portions 31B-1 and the second contact portion 41A can be more reliably ensured.

At a position below the lower surface of the front wall 12 (excluding the lower protruding portions 12B), the second extending portion 44 is bent at a lower end of the second vertical portion 42B, and extends forward. The second extending portion 44 is positioned within the area of the front wall 12 in the front-back direction, extends along the lower surface of the front wall 12, and further extends forward beyond the front surface of the front wall 12. The second extending portion 44 is positioned in the area of the second horizontal portion 42A as the second base portion in the terminal array direction. Moreover, the second extending portion 44 has the same terminal width as that of the first forward-extending portion 33 of the first arm member 30, is at the same position as that of the first forward-extending portion 33 in the front-back direction and the upper-lower direction, and is positioned differently from the first forward-extending portion 33 and is adjacent to the first forward-extending portion 33 in the terminal array direction.

Of the second extending portion 44, a portion positioned at the front of the front wall 12 is formed as the second mounting portion 44A mounted on the mounting surface of the circuit board by soldering. When the connector 1 is arranged on the mounting surface of the circuit board, the second mounting portion 44A surface-contacts, at a lower surface thereof, the same corresponding circuit portion (not shown) as the corresponding circuit portion on which the first front mounting portion 33A of the first arm member 30 is mounted, and is connectable to the corresponding circuit portion by soldering.

As shown in FIG. 5C, the second mounting portion 44A is formed with a second narrow portion 44A-1 at a back end portion, i.e., an end portion positioned on the front wall 12 side. A side edge of the second narrow portion 44A-1 extending in the front-back direction on the Y2 side is positioned recessed to the Y1 side with respect to a Y2-side edge of other portions of the second extending portion 44. With this configuration, the second narrow portion 44A-1 has a smaller terminal width than that of the other portions of the second extending portion 44. At the second mounting portion 44A, the second recessed portion 44A-2 as an opening is formed on the Y2 side of the above-described back end portion by the second narrow portion 44A-1. That is, the second recessed portion 44A-2 is in such a shape that the Y2-side edge of the back end portion of the second mounting portion 44A as described above is cut out in a rectangular shape, and opens to the Y2 side.

In the present embodiment, a space between the first narrow portion 33A-1 and the second narrow portion 44A-1 in the terminal array direction, i.e., a space formed between the first recessed portion 33A-2 and the second recessed portion 44A-2, is formed as the pin insertable space 20A allowing insertion of a die pin (not shown), which is provided at a molding die, in the upper-lower direction when the terminal 20 is held on the housing 10 by insert molding.

Of one terminal 20, the dimension of a clearance between the first narrow portion 33A-1 and the second narrow portion 44A-1 in the terminal array direction, i.e., the dimension (indicated by "P1" in FIG. 5C) of the pin insertable space 20A, is greater than a clearance between portions of the first front vertical portion 32B and the second vertical portion 42B positioned immediately at the back of the front wall 12 and greater than a clearance between the first forward-extending portion 33 (excluding the first narrow portion 33A-1) and the second extending portion 44 (excluding the second narrow portion 44A-1) in the terminal array direction. FIG. 5C shows a state in which the dimension P1 of the pin insertable space 20A in the terminal array direction is greater than the clearance P2 between the portions (the dashed portions in FIG. 5C) of the first forward-extending portion 33 and the second extending portion 44 positioned at the back of the front surface of the front wall 12 of the housing 10.

Figure 2A:
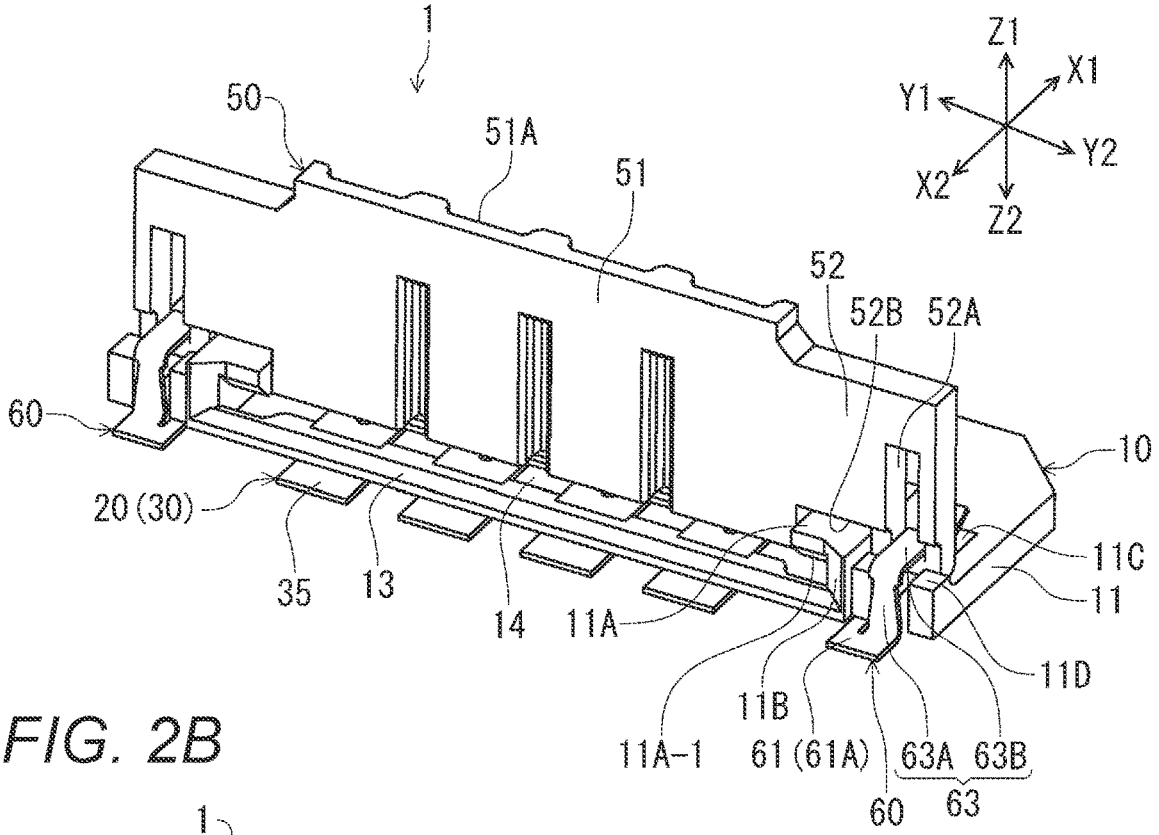
FIGS. 2A and 2B show perspective views of the flat conductor electric connector of FIGS. 1A and 1B in a state in which a movable member is at an open position, FIG. 2A showing a state as viewed from a back side and FIG. 2B showing a state as viewed from a front side.
Figure 2B:
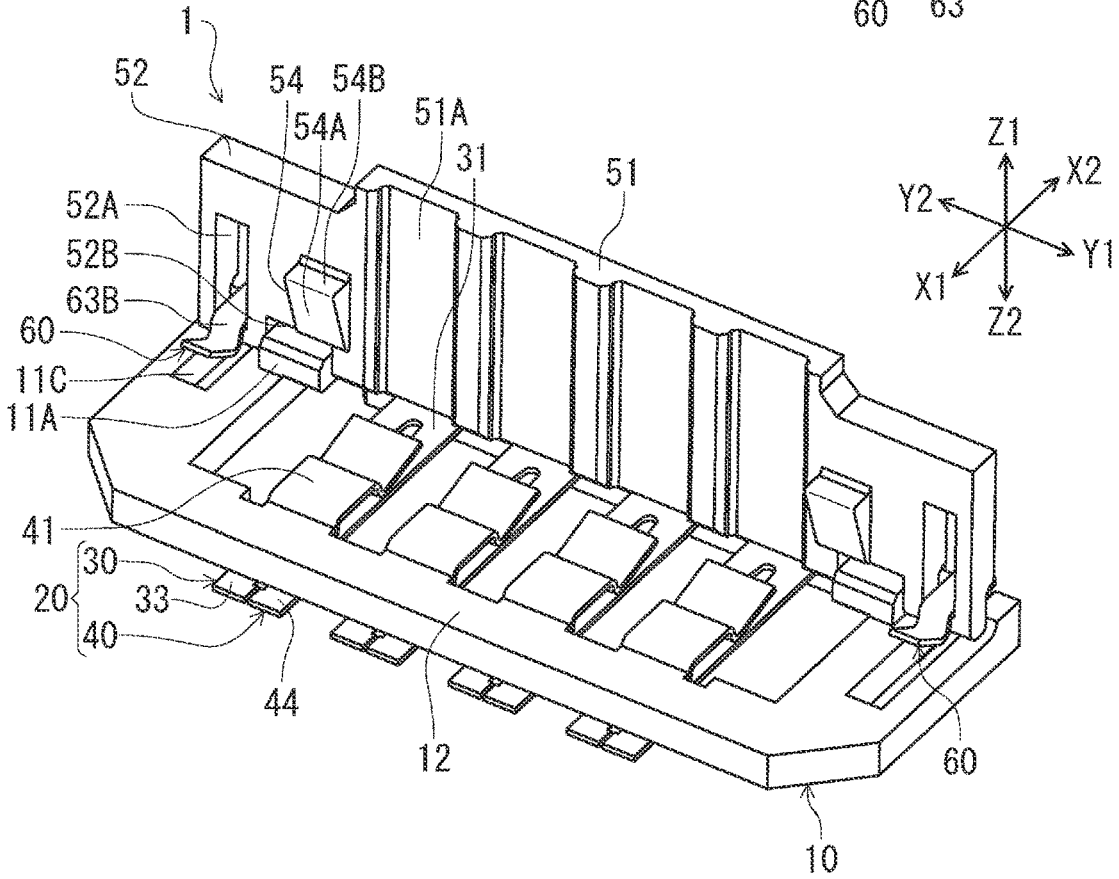

The movable member 50 is provided above the housing 10 and the terminals 20, and is turnable about the axis of the later-described turning shaft portion 53 between the closed position at which the movable member 50 is in a posture parallel with the circuit board (not shown) as shown in FIGS. 1A and 1B and the open position at which the movable member 50 is in a posture standing in the upper-lower direction as shown in FIGS. 2A and 2B. When the movable member 50 is at the closed position, detachment of the flat conductor C is inhibited. When the movable member 50 is at the open position, detachment of the flat conductor C is allowed.

As shown in FIG. 3 showing the same posture as that at the open position, the movable member 50 has a plate-shaped body portion 51 extending in a longitudinal direction which is the terminal array direction (the Y-axis direction), end plate portions 52 provided at both end positions of the body portion 51 in the terminal array direction, the turning shaft portions 53 provided on a lower end side of the end plate portions 52, and the locking portions 54 (see FIG. 2B) protruding forward (the X1 direction) from the end plate portions 52.

The movable member 50 is positioned across the substantially same area as that of the housing 10 in the terminal array direction. In the front-back direction, the movable member 50 is positioned to cover the substantially entire area of the receiving portion 14 when the movable member 50 is at the closed position (see FIGS. 1A, 1B, and 5A), and is positioned on a back end side of the housing 10 when the movable member 50 is at the open position (see FIGS. 2A and 2B).

As shown in FIG. 2B, groove-shaped body groove portions 51A extending in the upper-lower direction at positions corresponding to the terminals 20 in the terminal array direction are formed at a front surface (a surface on the X1 side) of the body portion 51 when the movable member 50 is at the open position. Since the body groove portions 51A are formed at the body portion 51 as described above, contact of the body portion 51 with the second contact arm portions 41 of the second arm members 40 of the terminals 20 when the body portion 51 is at the closed position can be avoided.

As shown in FIG. 2B, at the end plate portion 52, a slit-shaped end groove portion 52A extending downward from a position close to an upper end and penetrating the end plate portion 52 in the front-back direction is formed at a position corresponding to the side groove portion 11C of the housing 10 and the later-described restriction arm portion 63 of the metal fitting 60 in the terminal array direction. When the movable member 50 is at the closed position, the end groove portion 52A is positioned within the area of the side groove portion 11C of the housing 10 in the front-back direction, and houses a later-described bent arm portion 63B-2 of the metal fitting 60 (see FIG. 7C). Moreover, as shown in FIGS. 2B and 3, at the end plate portion 52, a lower end of the end plate portion 52 is recessed with respect to a lower end of the body portion 51 at a position corresponding to the guide portion 11A of the housing 10 in the front-back direction and the terminal array direction, thereby forming an end recessed portion 52B. As shown in FIGS. 1A, 1B, and 2B, the end recessed portion 52B houses the guide portion 11A, and accordingly, contact among the movable member 50 and the guide portions 11A is avoided.

Figure 7A:
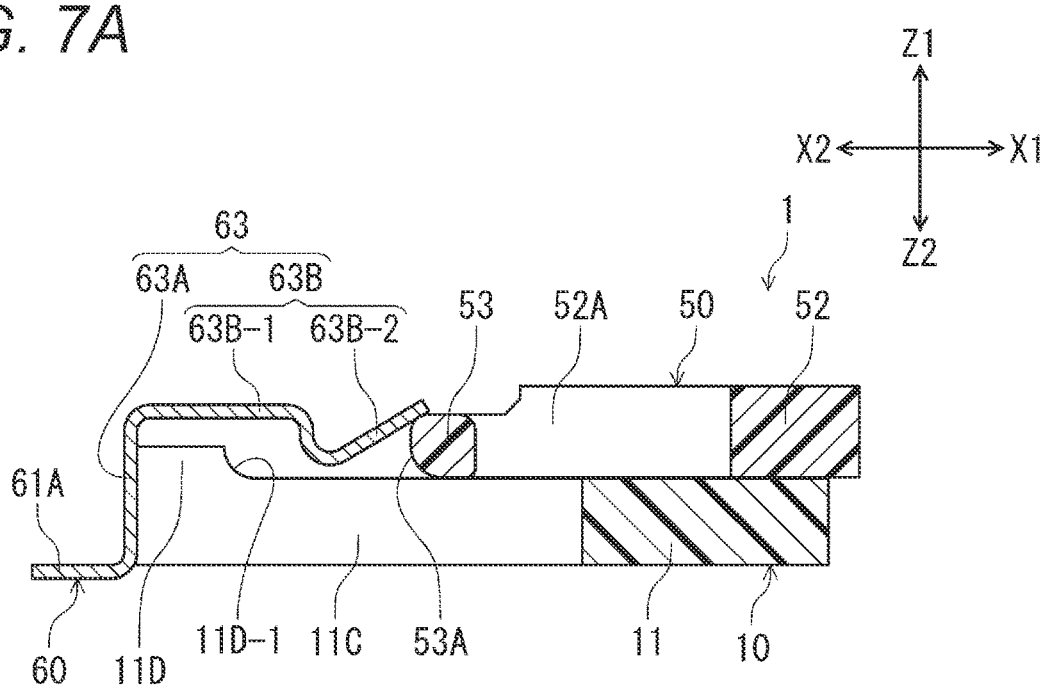
FIGS. 7A, 7B and 7C show longitudinal sectional views of the steps of attaching the movable member upon manufacturing of the flat conductor electric connector, FIG. 7A showing a state immediately before attachment, FIG. 7B showing a state in the middle of attachment, and FIG. 7C showing a state after completion of attachment.
Figure 7B:
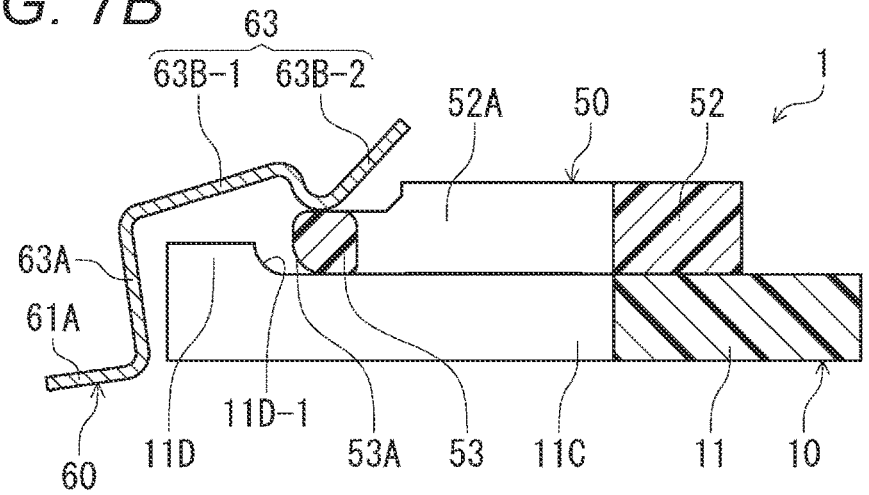
Figure 7C:
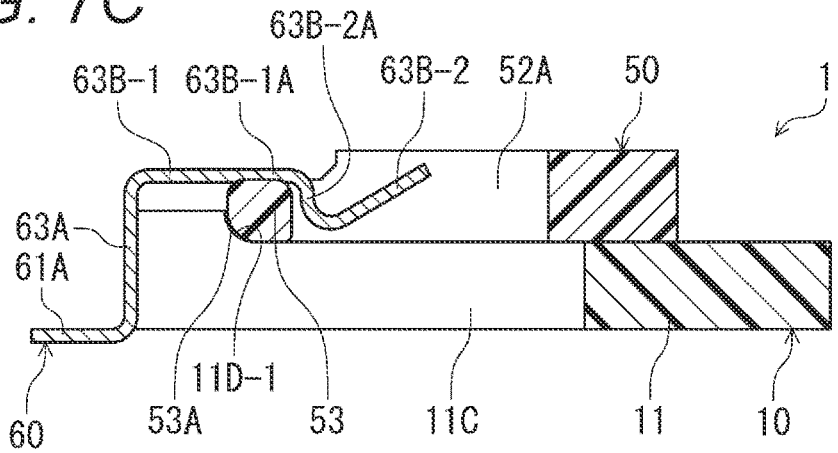

As shown in FIG. 3, the turning shaft portion 53 is provided coupled to the lower end of the end plate portion 52 at a position outside the end recessed portion 52B in the terminal array direction, and extends across an area including the end groove portion 52A. As shown in FIGS. 7A to 7C, the turning shaft portion 53 is configured such that the sectional shape thereof along a plane perpendicular to the terminal array direction is a substantially rectangular shape and a surface thereof in an area from a back surface to a lower surface when the movable member 50 is at the closed position forms a single continuous raised curved surface. This raised curved surface is curved with the substantially same curvature as that of the support surface 11D-1 of the housing 10, and forms a support target surface 53A turnably supported by the support surface 11D-1 in the course of turning the movable member 50.

Figure 6A:
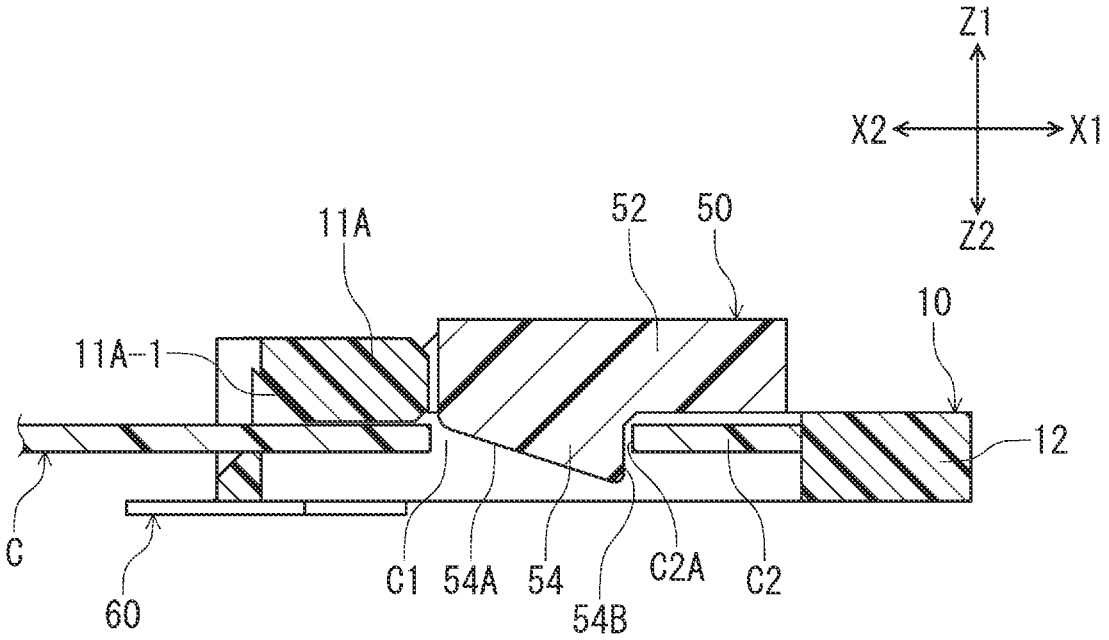
FIGS. 6A and 6B show longitudinal sectional views of the flat conductor electric connector after insertion of the flat conductor, FIG. 6A showing a section at the position of a locking portion of the movable member in the terminal array direction and FIG. 6B showing a section at the position of a first contact arm portion of the first arm member in the terminal array direction.
Figure 6B:
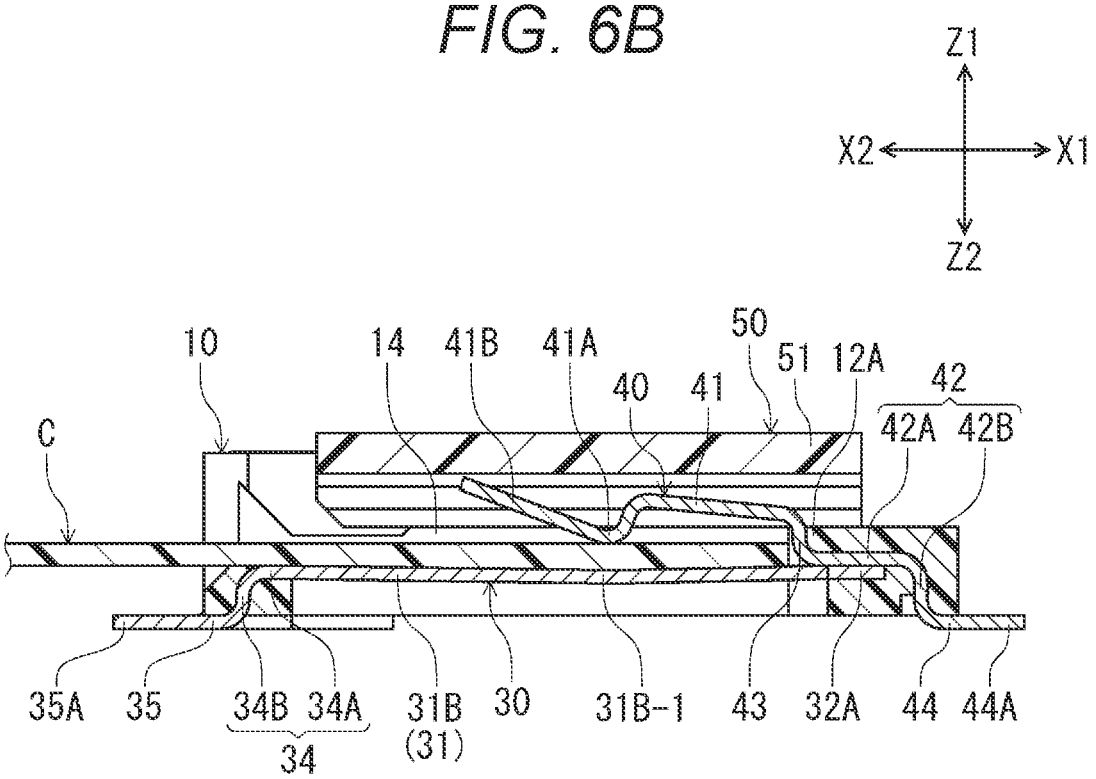

As shown in FIG. 2B, the locking portion 54 is, in a state in which the end plate portion 52 is at the open position, positioned above the end recessed portion 52B and slightly inward from the end recessed portion 52B in the terminal array direction, and protrudes from the front surface (a lower surface at the closed position) of the end plate portion 52 (also see FIG. 6A). The locking portions 54 are, in the terminal array direction, positioned corresponding to both outer sides of an area where the terminals 20 are arrayed, specifically the side edge portions of the flat conductor C. As shown in FIG. 6A, a lower surface of the locking portion 54 when the movable member 50 is at the closed position is formed as an inclined surface 54A inclined downward toward the front, and a front surface of the locking portion 54 is formed as a locking surface 54B forming a flat surface perpendicular to the front-back direction. As shown in FIG. 6A, when the movable member 50 is brought into the closed position after insertion of the flat conductor C, the locking portions 54 enter the cutout portions C1 of the flat conductor C from above. As a result, the locking portions 54 are positioned such that the locking surfaces 54B thereof are lockable to the locking target portions C2A at the back thereof, and detachment of the flat conductor C is inhibited accordingly.

Figure 4C:
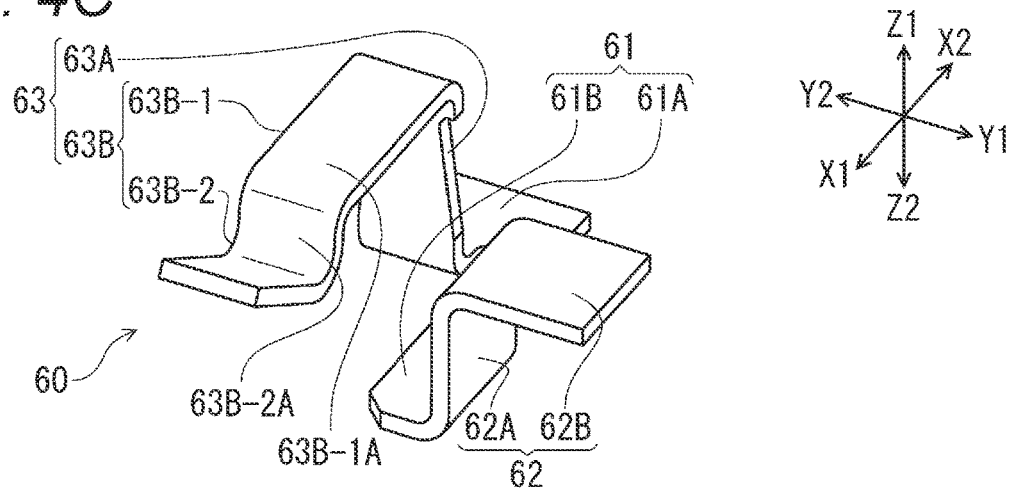
FIG. 4C shows a perspective view of a metal fitting.

As shown in FIGS. 3 and 4C, the metal fitting 60 is formed in such a manner that a metal plate member is bent in a plate thickness direction. The two metal fittings 60 provided at the connector 1, i.e., the metal fitting 60 positioned on the Y1 side and the metal fitting 60 positioned on the Y2 side, have shapes symmetrical to each other in the terminal array direction. Hereinafter, the metal fitting 60 on the Y2 side will be described, and description of the metal fitting 60 on the Y1 side will be omitted. As shown in FIGS. 3 and 4C, the metal fitting 60 has a fixing portion 61 extending to face the mounting surface of the circuit board (not shown), a reinforcing portion 62 held on the housing 10 by insert molding, and the restriction arm portion 63 supporting the turning shaft portion 53 of the movable member 50 and restricting upward and forward movement of the turning shaft portion 53.

The fixing portion 61 is formed in such a flat plate shape that a plate surface (a surface perpendicular to the plate thickness direction) thereof is parallel with the mounting surface of the circuit board (not shown), and is in a substantially L-shape as viewed from above. The fixing portion 61 has a back fixing portion 61A extending in the terminal array direction and a front fixing portion 61B extending forward from the back fixing portion 61A at an inner position in the terminal array direction. As shown in FIGS. 1A and 1B, the back fixing portion 61A is positioned at the back of the side wall 11 of the housing 10. The front fixing portion 61B extends forward along a lower surface of the side wall 11 at a position inside the side groove portion 11C in the terminal array direction. The fixing portion 61 surface-contacts, at a lower surface thereof, a corresponding portion of the mounting surface of the circuit board, and is connected and fixed to such a mounting surface by soldering.

The reinforcing portion 62 has a vertical plate portion 62A bent at an inner edge in the terminal array direction at a front end portion of the front fixing portion 61B and extending upward and a horizontal plate portion 62B bent at an upper edge of the vertical plate portion 62A and extending inward in the terminal array direction. The reinforcing portion 62 is positioned within the area of the guide portion 11A of the side wall 11 in the front-back direction. The vertical plate portion 62A is embedded in an inner portion of the side wall 11 with respect to the side groove portion 11C, thereby reinforcing such an inner portion. The horizontal plate portion 62B is embedded in the guide portion 11A to reinforce the guide portion 11A.

The restriction arm portion 63 has a vertical arm portion 63A bent at a front edge of the back fixing portion 61A at a position outside the back fixing portion 61A in the terminal array direction and extending upward and the horizontal arm portion 63B bent at an upper edge of the vertical arm portion 63A and extending forward. The restriction arm portion 63 is positioned corresponding to the side groove portion 11C of the housing 10 and the turning shaft portion 53 of the movable member 50 in the terminal array direction. The vertical arm portion 63A is positioned at the back of the side groove portion 11C. The horizontal arm portion 63B extends forward at immediately above the side groove portion 11C, and as shown in FIG. 2A, is positioned to penetrate the end groove portion 52A of the movable member 50 at the open position.

As shown in FIGS. 4A to 4C and FIG. 7C, the horizontal arm portion 63B is bent downward at an intermediate position in the front-back direction, and is further bent diagonally forward-upward. As a result, a substantially back half portion of the horizontal arm portion 63B forms a linear arm portion 63B-1 linearly extending in the front-back direction, and a substantially front half portion of the horizontal arm portion 63B forms the substantially V-shaped bent arm portion 63B-2 as viewed in the terminal array direction. As shown in FIG. 7C, the linear arm portion 63B-1 is configured such that a front end side portion thereof is formed as an upper restriction portion 63B-1A configured to contact the turning shaft portion 53 from above to restrict excessive upward movement of the turning shaft portion 53. Moreover, the bent arm portion 63B-2 is configured such that a portion thereof extending in the upper-lower direction is formed as a front restriction portion 63B-2A positioned contactable with the turning shaft portion 53 from the front to restrict excessive forward movement of the turning shaft portion 53. The upper restriction portion 63B-1A and the front restriction portion 63B-2A can constantly restrict excessive upward and forward movement of the turning shaft portion 53 even when the movable member 50 is at any turning position, and therefore, unexpected detachment of the movable member 50 from the housing 10 can be favorably prevented.

The connector 1 according to the present embodiment is manufactured in the following manner. First, the second horizontal portions 42A of the second arm members 40 are arranged in the molding die (not shown) in a state in which each second horizontal portion 42A overlaps with a corresponding one of the first front horizontal portions 32A of the first arm members 30 from above, and the metal fittings 60 are also arranged in the molding die. The molding die can be divided into multiple parts, and the die pins for molding the housing in a state in which the positions of the first arm members 30 and the second arm members 40 are set are provided to extend in the upper-lower direction at least at one of an upper die arranged from above and a lower die arranged from below. The die pin is inserted in the upper-lower direction into the pin insertable space 20A (see FIG. 5C) formed between the first narrow portion 33A-1 and the second narrow portion 44A-1. At this point, the pin is inserted and positioned at a front half portion in the pin insertable space 20A.

In the present embodiment, the die pin of the molding die can enter the above-described pin insertable space 20A, and therefore, even if the first arm member 30 and the second arm member 40 are arrayed adjacent to each other in the terminal array direction with a narrow clearance therebetween, it is not necessary to thinly form the die pin and the die pin with a sufficient strength can be arranged upon insert molding of the terminals 20 and the housing 10. Thus, the terminals can be densely arrayed at proper positions without the need for narrowing the entire area of the terminal and increasing a terminal array pitch.

Next, molten resin is injected into the molding die, and thereafter, is solidified. In this manner, the housing 10 is formed. As a result, the first arm members 30, the second arm members 40, and the metal fittings 60 are held on the housing 10 by insert molding (integral molding).

Next, the movable member 50 is attached to the housing 10 from the front. The steps of attaching the movable member 50 will be described based on FIGS. 7A to 7C. First, as shown in FIG. 7A, the movable member 50 in the posture at the closed position is arranged on the housing 10 at a position at the front of the metal fittings 60. Next, the movable member 50 is moved backward while the posture thereof at the closed position is maintained. At this point, the turning shaft portions 53 contact, from the front, front end side portions of the bent arm portions 63B-2 of the metal fittings 60, i.e., portions inclined diagonally forward-upward, and accordingly, the bent arm portions 63B-2 and therefore the horizontal arm portions 63B are elastically displaced upward. As a result, further backward movement of the movable member 50 is allowed.

Upon attachment of the movable member 50, the fixing portions 61 of the metal fittings 60 are not fixed to the mounting surface of the circuit board. Thus, the metal fittings 60 are elastically displaceable, taking, as an arm length, the entire length of a portion along an area from a front end portion of the restriction arm portion 63 to the front end portion of the front fixing portion 61B. That is, in the course of attaching the movable member 50, the horizontal arm portions 63B, the vertical arm portions 63A, and the fixing portions 61 are elastically displaced as shown in FIG. 7B. In the present embodiment, the horizontal arm portions 63B are easily displaced upward because a great arm length can be ensured as described above. As a result, the movable member 50 is easily attached.

When the turning shaft portions 53 of the movable members 50 reach a position at the back of the bent arm portions 63B-2, the elastic displacement amounts of the horizontal arm portions 63B, the vertical arm portions 63A, and the fixing portions 61 decrease. As a result, the horizontal arm portions 63B move downward, and as shown in FIG. 7C, the upper restriction portions 63B-1A of the linear arm portions 63B-1 contact the turning shaft portions 53 from above, and the front restriction portions 63B-2A of the bent arm portions 63B-2 are positioned contactable with the turning shaft portions 53 from the front. In this manner, the movable member 50 is attached to the housing 10, and the connector 1 is completed.

Next, motion for connecting the connector 1 and the flat conductor C to each other will be described based on FIGS. 1A to 2B and FIGS. 6A, and 6B. First, the first front mounting portions 33A and the first back mounting portions 35A of the first arm members 30 of the terminals 20 and the second mounting portions 44A of the second arm members 40 of the terminals 20 are each connected to the corresponding circuit portions of the circuit board by soldering, and the fixing portions 61 of the metal fittings 60 are connected and fixed to the corresponding portions of the circuit board by soldering.

The metal fittings 60 are fixed to the circuit board by soldering, and accordingly, elastically-displaceable portions of the metal fittings 60 are only the restriction arm portions 63. Thus, as compared to the time of attachment of the movable member 50 in manufacturing of the connector 1, the arm length of the metal fitting 60 for elastic displacement is shortened, and the restriction arm portion 63 is less likely to be elastically displaced. As a result, detachment of the movable member 50 from the housing 10 after the connector 1 has been mounted on the circuit board can be more reliably prevented.

Next, as shown in FIGS. 1A and 1B, in a state in which the movable member 50 is at the closed position, the flat conductor C is positioned at the back of the connector 1 to extend in the front-back direction along the mounting surface of the circuit board (not shown).

Next, the flat conductor C is inserted forward into the receiving portion 14 of the connector 1. At this point, the flat conductor C is guided into the receiving portion 14 by the upper guide surfaces 11A-1, the side guide surfaces 11B, and the lower guide surface 13A of the housing 10. In the course of insertion into the connector 1, when the front end of the flat conductor C contacts the inclined surfaces 54A of the locking portions 54 of the movable member 50, forward force (component force) and upward force (component force) act on the inclined surfaces 54A. As a result, the locking portions 54 and therefore the movable member 50 are, by the upward force, lifted by the thickness dimension of the flat conductor C, and further entrance of the flat conductor C is allowed. At this point, the upper restriction portions 63B-1A of the metal fittings 60 receive the upward force from the turning shaft portions 53 of the movable member 50, and the horizontal arm portions 63B are elastically displaced upward. Accordingly, upward movement of the movable member 50 is allowed.

Immediately after the front end of the flat conductor C has started lifting the locking portions 54, the front end of the flat conductor C contacts plate surfaces (inclined surfaces) of the back end inclined portions 41B of the second contact arm portions 41 of the second arm members 40, and the second contact arm portions 41 are elastically displaced upward. Then, the flat conductor C enters a portion among the second contact portions 41A and the first contact portions 31B-1 of the first arm members 30 (see FIG. 6B).

When the front end of the flat conductor C contacts a back surface of the front wall 12, the ear portions C2 of the flat conductor C pass by the position of the locking portion 54 of the movable member 50, and the cutout portions C1 reach the position of the locking portion 54. As a result, as shown in FIG. 6A, the movable member 50 returns to the closed position, the locking portions 54 enter the cutout portions C1 from above, and the locking surfaces 54B of the locking portions 54 are positioned lockable to the locking target portions C2A of the flat conductor C from the back. The locking portions 54 are lockable to the locking target portions C2A as described above, and therefore, unexpected backward detachment of the flat conductor C is prevented.

Moreover, when the front end of the flat conductor C contacts the back surface of the front wall 12 and insertion of the flat conductor C is completed, the state in which the second contact arm portions 41 are elastically displaced is maintained and the second contact portions 41A press the flat conductor C from above, as shown in FIG. 6B. That is, the flat conductor C is sandwiched in the upper-lower direction by the first contact portions 31B-1 and the second contact portions 41A. As a result of the flat conductor C receiving pressing force from above from the second contact portions 41A, the circuit portions exposed at the lower surface of the flat conductor C are pressed against the first contact portions 31B-1 from above, contact the first contact portions 31B-1 with contact pressure, and are brought into electric conduction with the first contact portions 31B-1. At this point, as shown in FIG. 6B, the first contact portions 31B-1 receive force from above from the circuit portions, and the contact stripe portions 31B are slightly elastically displaced downward.

In the present embodiment, the flat conductor C enters the portion among the first contact portions 31B-1 and the second contact portions 41A and the second contact arm portions 41 are elastically displaced upward, and accordingly, the force in the elastic displacement direction, i.e., the upward force of separating the second horizontal portions 42A from the first front horizontal portions 32A, acts on the second horizontal portions 42A of the second arm members 40. However, as shown in FIG. 6B, the second horizontal portions 42A of the second arm members 40 are, at the upper surfaces thereof, supported on the front wall 12, and therefore, the second horizontal portions 42A can resist the upward force acting thereon and separation of the first front horizontal portions 32A and the second horizontal portions 42A can be prevented.

Moreover, in the present embodiment, the second contact arm portions 41 of the second arm members 40 are elastically displaced upward, and accordingly, the force having the forward component acts on the coupling portions 43. As shown in FIG. 6B, the front surfaces of the coupling portions 43 of the second arm members 40 are supported on the back surfaces of the support protruding portions 12A of the front wall 12. Thus, the coupling portions 43 can resist the above-described force acting thereon. This can also prevent separation of the first front horizontal portions 32A and the second horizontal portions 42A.

As described above, in the present embodiment, separation of the first front horizontal portions 32A and the second horizontal portions 42A is favorably prevented, and therefore, a sufficiently-great contact pressure on the flat conductor C for sandwiching the flat conductor C by the first contact portions 31B-1 and the second contact portions 41A can be more reliably ensured.

When the flat conductor C is detached from the connector 1, the movable member 50 is turned and brought into the open position. As a result, the locking portions 54 of the movable member 50 are taken out of the cutout portions C1 of the flat conductor C, and a locked state among the locking portions 54 and the locking target portions C2A of the flat conductor C is canceled. Thus, the flat conductor C can be pulled backward and be detached from the connector 1 with no difficulty.

The embodiment of the present invention is not limited to the already-described embodiment, and various modifications can be made. In the already-described embodiment, the first forward-extending portion 33 and the first backward-extending portion 35 of the first arm member 30 and the second extending portion 44 of the second arm member 40 are positioned below the lower surface of the housing 10. However, as shown in FIGS. 8A and 8B, these portions may be provided at the same height position as that of the lower surface of the housing 10 in the upper-lower direction.

Figure 8A:
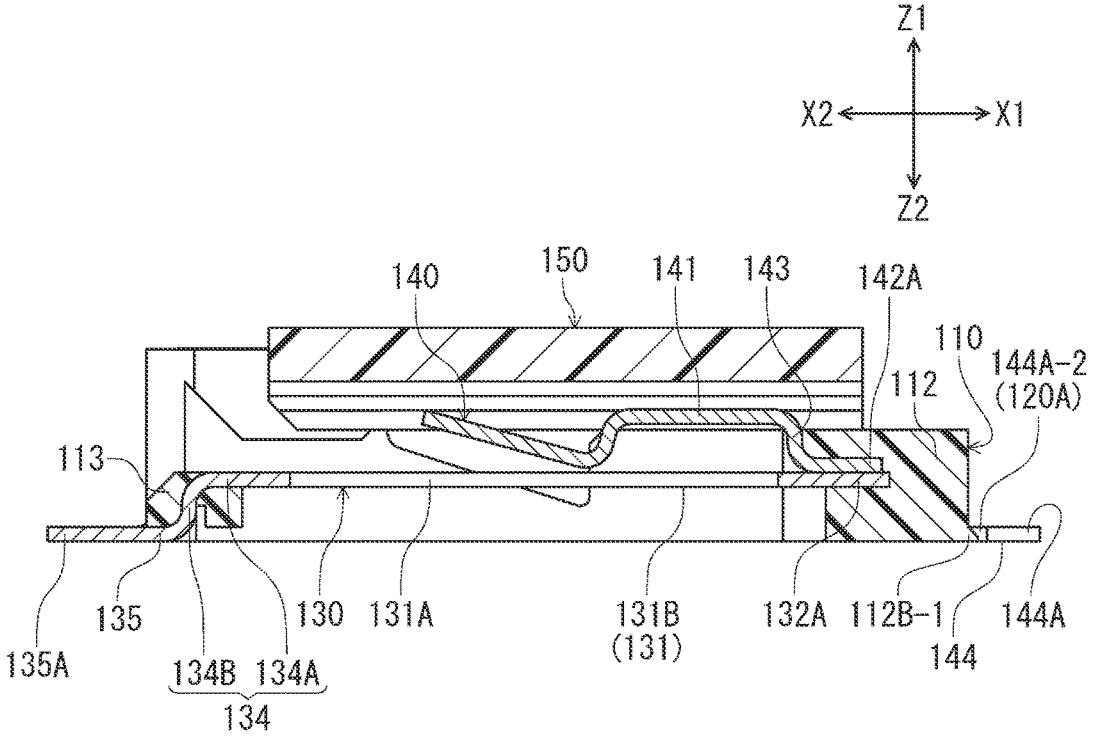
FIG. 8A shows a longitudinal sectional view at the position of a slit of a first arm member in a terminal array direction of a flat conductor electric connector according to a variation.
Figure 8B:
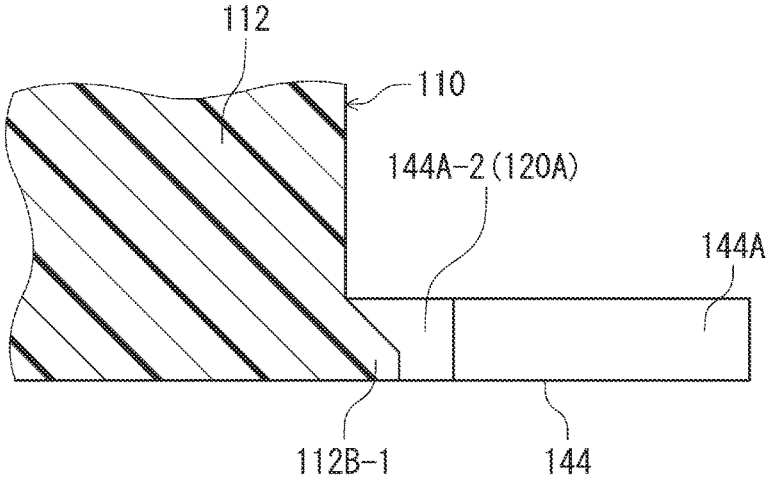
FIG. 8B shows a partially-enlarged view.

FIGS. 8A and 8B indicate portions of a housing, a first arm member, a second arm member, and a movable member corresponding to those in the already-described embodiment by such reference numerals that "100" is added to the reference numerals in the already-described embodiment. In this variation, a first forward-extending portion (not shown) and a first backward-extending portion 135 of a first arm member 130 and a second extending portion 144 of a second arm member 140 are, at lower surfaces thereof, positioned at the same height as that of a lower surface of a housing 110 in the upper-lower direction. Moreover, no portion equivalent to the lower protruding portion 12B (see FIGS. 5A and 5B) in the already-described embodiment is formed at a front wall 112 of the housing 110. As shown in FIGS. 8A and 8B, a front end protruding portion 112B-1 equivalent to the front end protruding portion 12B-1 in the already-described embodiment is formed to protrude from a front surface of a lower portion of the front wall 112. The front end protruding portion 112B-1 is a portion corresponding to the front end protruding portion 12B-1 in the already-described embodiment, and is formed at a back half portion in a pin insertable space 120A formed between a first recessed portion (not shown) of a first front mounting portion and a second recessed portion 144A-2 of a second mounting portion 144A.

Moreover, in the already-described embodiment, the pin insertable space 20A is formed by the first recessed portion 33A-2 and the second recessed portion 44A-2 as the openings, and the first recessed portion 33A-2 and the second recessed portion 44A-2 are formed such that the opposing side edge portions (the edge portions extending in the front-back direction) of the first front mounting portion 33A and the second mounting portion 44A are cut out in the same shape and are symmetrical to each other in the terminal array direction (see FIGS. 4A and 5C). However, the positions, shapes, and sizes of the openings are not limited to above.

Figure 9A:
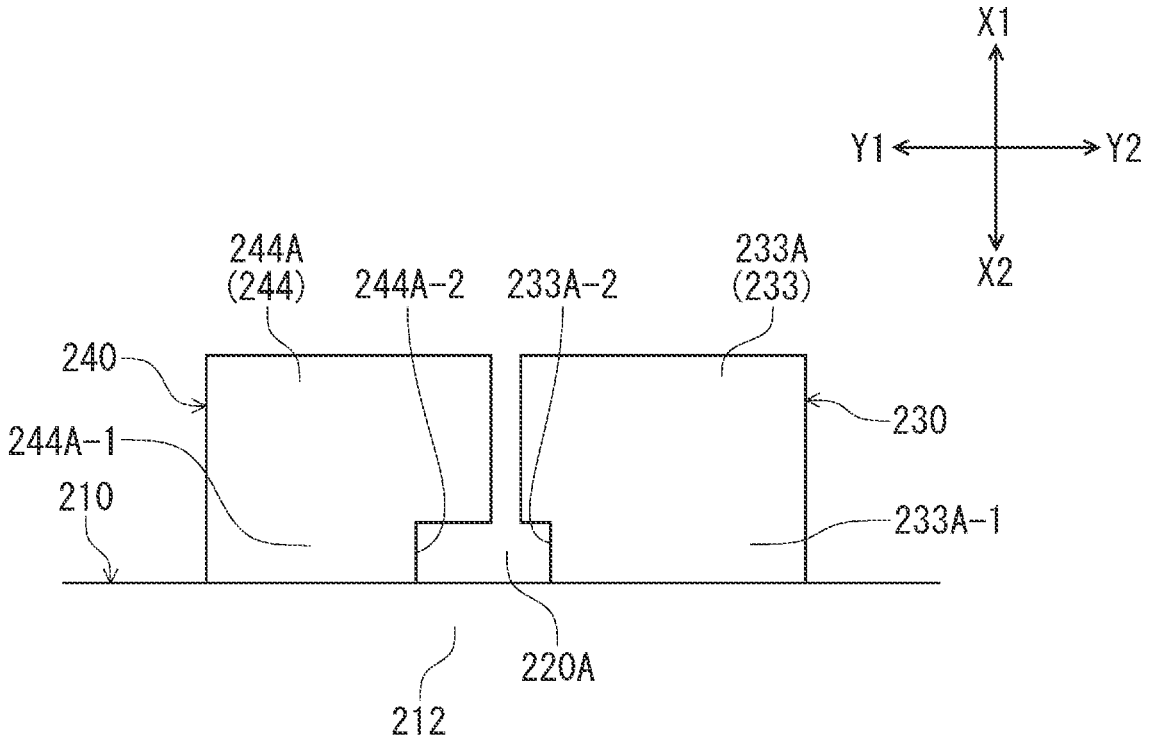
FIG. 9A shows a plan view of a mounting portion of a terminal in another variation.

For example, as in a variation shown in FIG. 9A, an opening may be formed between a first recessed portion 233A-2 and a second recessed portion 244A-2 having different shapes. FIG. 9A indicates portions of a housing, a first arm member, and a second arm member corresponding to those in the already-described embodiment by such reference numerals that "200" is added to the reference numerals in the already-described embodiment. Description of portions with the same shapes as those of the already-described embodiment will be omitted. This variation is similar to the already-described embodiment on the point that the first recessed portion 233A-2 of a first front mounting portion 233A and the second recessed portion 244A-2 of a second mounting portion 244A are, at opposing side edge portions thereof, cut out at the same position in the front-back direction, but is different from the already-described embodiment on the point that the second recessed portion 244A-2 is greatly cut out in the terminal array direction as compared to the first recessed portion 233A-2 and the first recessed portion 233A-2 and the second recessed portion 244A-2 are asymmetric to each other.

Figure 9B:
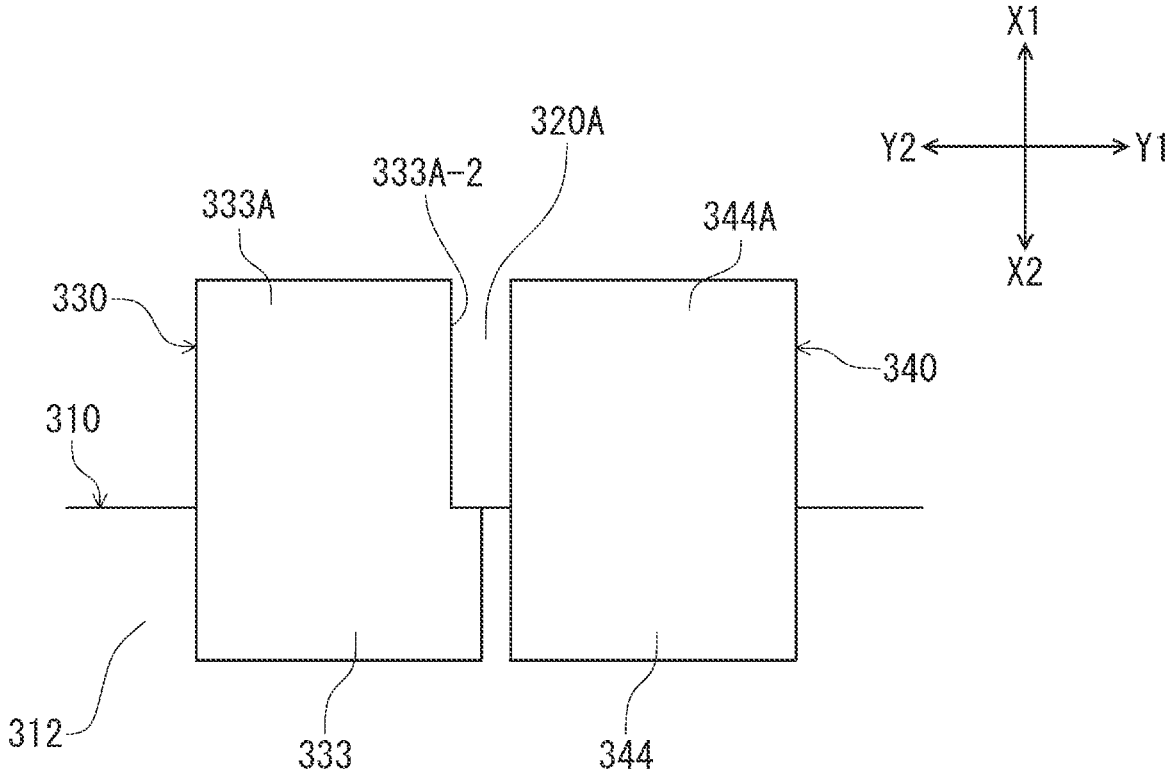
FIG. 9B shows a bottom view of a mounting portion of a terminal in still another variation.

Moreover, as in a variation shown in FIG. 9B, a pin insertable space 320A may be formed in such a manner that a narrow portion is formed only at one of a first front mounting portion 333A or a second mounting portion 344A. FIG. 9B indicates portions of a housing, a first arm member, and a second arm member corresponding to those in the already-described embodiment by such reference numerals that "300" is added to the reference numerals in the already-described embodiment. Description of portions with the same shapes as those of the already-described embodiment will be omitted. In this variation, a Y1-side edge of the first front mounting portion 333A of a first forward-extending portion 333 is positioned on the Y2 side with respect to a Y1-side edge of a portion other than the first front mounting portion 333A, and accordingly, a first front narrow portion 333A-1 is formed. On the other hand, no narrow portion is formed at the second mounting portion 344A.

Moreover, in the variation of FIG. 9B, the first front mounting portion 333A has a narrow terminal width across the entire area in the front-back direction, and the entirety of the first front mounting portion 333A forms a narrow portion. Thus, the pin insertable space 320A formed between the first front mounting portion 333A and the second mounting portion 344A is formed across the entire areas of the first front mounting portion 333A and the second mounting portion 344A in the front-back direction.

Figure 10:
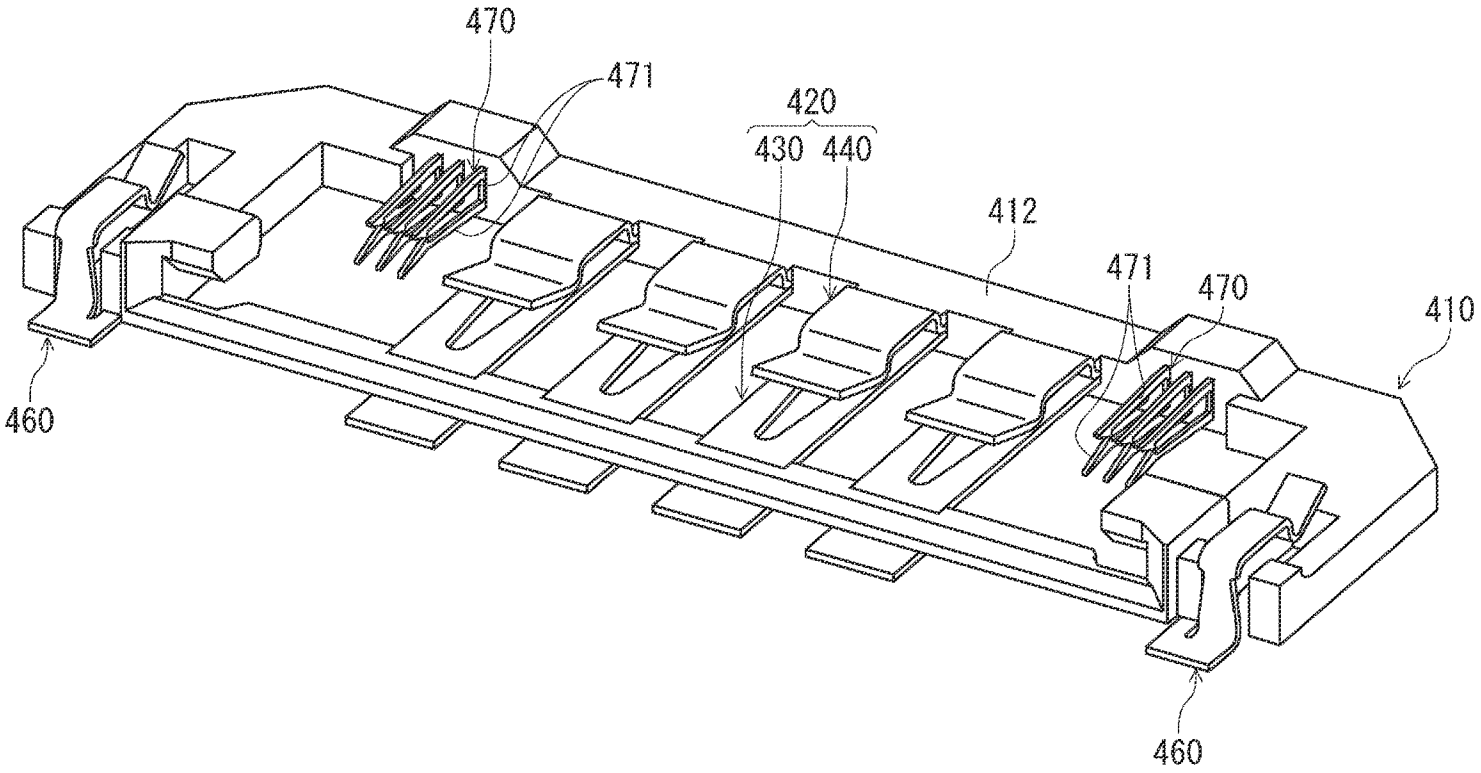
FIG. 10 shows a perspective view of the connector in still another variation without a movable member.

In the already-described embodiment, only one type of terminal, i.e., only the terminals 20 as the power supply terminals, is provided at the connector. However, as a variation, other types of terminals different from the above-described terminals in shape may be provided at the connector in addition to the above-described terminals. On this point, as shown in FIG. 10, the other types of terminals may be provided as, e.g., signal terminals. FIG. 10 is a perspective view showing the connector of such a variation without a movable member. In the variation shown in FIG. 10, it is configured such that at the connector 1 in the already-described embodiment, multiple signal terminals are provided on both outer sides of the area where the terminals 20 are arrayed. FIG. 10 indicates portions corresponding to those in the already-described embodiment by such reference numerals that "400" is added to the reference numerals in the already-described embodiment. Description of portions with the same shapes as those of the already-described embodiment will be omitted.

A signal terminal 470 in this variation is formed in such a manner that a flat metal plate member is punched out in a plate thickness direction. The signal terminal 470 is held on a front wall 412 of a housing 410 by insert molding in a posture in which the plate thickness direction of the signal terminal 470 is coincident with the terminal array direction. The signal terminal 470 sandwiches the flat conductor by two elastically-displaceable contact arm portions 471 extending backward from the front wall 412, and is electrically connected to the flat conductor. The form for holding the signal terminal 470 as described herein is not limited to holding by insert molding, and may be holding by press-fitting, for example. In the case of holding by press-fitting, the signal terminal 470 is press-fitted in a terminal holding groove formed at the front wall 412 of the housing 410.

In the already-described embodiment, all of the terminals 20 are used as the power supply terminals. Instead, in the case of providing multiple terminals of the same type with the same shape, some of the terminals and the other terminals may be different from each other in intended use. For example, some of the multiple terminals may be used as power supply terminals, and the other terminals may be used as signal terminals.

Moreover, in the already-described embodiment, the circuit portions of the flat conductor are exposed at the lower surface of the front end side portion of the flat conductor, and contact the first contact portions of the first arm members. Instead, the circuit portions may be exposed at an upper surface of the front end side portion of the flat conductor, and the second contact portions of the second arm members may contact and be electrically connected to the circuit portions. Alternatively, circuit portions forming two layers in the upper-lower direction may be formed at the flat conductor and may be exposed at both of the upper and lower surfaces of the front end side portion of the flat conductor, and the first contact portions of the first arm members may contact the circuit portion at the lower surface and the second contact portions of the second arm members may contact the circuit portion at the upper surface.

In the present embodiment, the terminal includes the two members, i.e., the first arm member and the second arm member. Instead, the terminal may include a single member. In this case, the extending portion of the terminal positioned to protrude from the housing in the front-back direction is not divided, but is formed as a single extending portion. On this point, at least at one of adjacent extending portions of adjacent terminals, a narrow portion is, as in the already-described embodiment, formed at least at an end portion positioned on a housing side and positioned outside the housing in the front-back direction, and an opening is formed by such a narrow portion. In this configuration, a clearance between a narrow portion of an optional extending portion and another extending portion adjacent to such a narrow portion with respect to the opening is greater than a clearance between holding target portions of adjacent terminals.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

The invention claimed is:

1. A flat conductor electric connector mounted on a circuit board and electrically connected to a front end side portion of a band-shaped flat conductor extending in a front-back direction, comprising:

multiple terminals in such a shape that metal plate members are bent in a plate thickness direction thereof; and a housing holding, by insert molding, the multiple terminals arrayed in a terminal array direction which is a band width direction, wherein each of the multiple terminals has, at least at one end portion in the front-back direction, a holding target portion held on the housing and an extending portion extending from the housing and formed with a mounting portion to be mounted on the circuit board by soldering, and the holding target portions adjacent to each other are arrayed and positioned in the terminal array direction with areas overlapping with each other in the front-back direction and the extending portions adjacent to each other are arrayed and positioned in the terminal array direction with areas overlapping with each other in the front-back direction, the extending portion includes a first extending portion and a second extending portion separated from each other in the terminal array direction at least at an end portion positioned outside the housing in the front-back direction, at least one of the first extending portion and the second extending portion has, on a housing side, a narrow portion which has a width in the terminal array direction narrower than a width of an end of first extending portion or the second extending portion, and an opening is formed by the narrow portion, and a clearance between the first extending portion and the second extending portion at the narrow portion is greater in the terminal array direction than a clearance between the ends of first extending portion and the second extending portion.

2. The flat conductor electric connector according to claim 1, wherein the opening of each terminal is formed as a recessed portion at a side edge of the extending portion.

3. A flat conductor electric connector mounted on a circuit board and electrically connected to a front end side portion of a band-shaped flat conductor extending in a front-back direction, comprising:

multiple terminals in such a shape that metal plate members are bent in a plate thickness direction thereof; and a housing holding, by insert molding, the multiple terminals arrayed in a terminal array direction which is a band width direction, wherein each of the multiple terminals has, at least at one end portion in the front-back direction, a holding target portion held on the housing and an extending portion extending from the housing and formed with a mounting portion to be mounted on the circuit board by soldering, and the holding target portions adjacent to each other are arrayed and positioned in the terminal array direction with areas overlapping with each other in the front-back direction and the extending portions adjacent to each other are arrayed and positioned in the terminal array direction with areas overlapping with each other in the front-back direction, the extending portion includes a first extending portion and a second extending portion separated from each other in the terminal array direction at least at an end portion positioned outside the housing in the front-back direction, at least one of the first extending portion and the second extending portion has, on a housing side, a narrow portion which has a width in the terminal array direction narrower than a width of an end of first extending portion or the second extending portion, and an opening is formed by the narrow portion, a clearance between the first extending portion and the second extending portion at the narrow portion is greater in the terminal array direction than a clearance between the ends of first extending portion and the second extending portion each terminal has a first terminal member and a second terminal member sandwiching the flat conductor in a thickness direction thereof, the first terminal member has the first extending portion and the second terminal member has the second extending portion, and the narrow portion is formed at the first extending portion and the second extending portion.

4. The flat conductor electric connector according to claim 3, wherein at a side edge of the first extending portion and a side edge of the second extending portion, openings are formed by recessed portions facing each other in the terminal array direction.

* * * * *